US007462046B2

(12) United States Patent
Burchell, Jr.

(10) Patent No.: US 7,462,046 B2
(45) Date of Patent: Dec. 9, 2008

(54) DEVICE FOR RESTRICTING UNAUTHORIZED ACCESS TO ELECTRICAL RECEPTACLES

(76) Inventor: Stanley C. Burchell, Jr., 3104 Lorient Dr., McHenry, IL (US) 60050

( * ) Notice: Subject to any disclaimer, the term of this patent is extended or adjusted under 35 U.S.C. 154(b) by 0 days.

(21) Appl. No.: 11/726,878

(22) Filed: Mar. 23, 2007

(65) Prior Publication Data

US 2008/0233777 A1 Sep. 25, 2008

(51) Int. Cl.
*H01R 13/44* (2006.01)

(52) U.S. Cl. ..... 439/135; 174/67

(58) Field of Classification Search ..... 439/135, 439/136, 372; 174/67, 66
See application file for complete search history.

(56) References Cited

U.S. PATENT DOCUMENTS

| | | | | | |
|---|---|---|---|---|---|
| 2,119,428 | A | | 5/1938 | Englar | |
| 3,096,409 | A | | 7/1963 | Hubell et al. | |
| 3,159,446 | A | | 12/1964 | Protzmann | |
| 3,200,989 | A | | 8/1965 | Hubbell | |
| 4,223,178 | A | | 9/1980 | Lass | |
| 4,247,743 | A | | 1/1981 | Hinton et al. | |
| 4,424,407 | A | * | 1/1984 | Barbic | 174/67 |
| 4,733,029 | A | | 3/1988 | Kobayashi et al. | |
| 4,851,612 | A | * | 7/1989 | Peckham | 174/67 |
| 4,970,349 | A | | 11/1990 | Jones | |
| 4,978,816 | A | | 12/1990 | Castonguay et al. | |
| 5,067,907 | A | * | 11/1991 | Shotey | 439/135 |
| 5,243,135 | A | | 9/1993 | Shotey | |
| 5,318,457 | A | | 6/1994 | Harting et al. | |
| 5,382,755 | A | * | 1/1995 | Correnti | 174/67 |
| 5,535,096 | A | | 7/1996 | Cliff, Jr. | |
| 5,554,045 | A | * | 9/1996 | Bethurum | 439/372 |
| 5,664,955 | A | * | 9/1997 | Arnett | 439/135 |
| 5,813,873 | A | | 9/1998 | McBain et al. | |
| 5,866,846 | A | | 2/1999 | Huag | |
| 6,051,788 | A | * | 4/2000 | Nichols | 174/67 |
| 6,198,046 | B1 | | 3/2001 | Moodie | |
| 6,310,291 | B1 | | 10/2001 | Clough | |
| 6,342,676 | B1 | | 1/2002 | Ha | |
| 6,494,728 | B1 | | 12/2002 | Gorman | |
| 6,501,022 | B2 | * | 12/2002 | Victor | 174/66 |
| 6,533,598 | B1 | | 3/2003 | Bentley et al. | |
| 6,669,492 | B1 | * | 12/2003 | McIlvenna | 439/135 |
| 6,805,580 | B2 | | 10/2004 | Piedmont | |
| 6,916,989 | B2 | | 10/2004 | Broussard, Jr. | |
| 6,986,678 | B1 | * | 1/2006 | Di-Nardo et al. | 439/372 |

(Continued)

*Primary Examiner*—Gary F. Paumen
(74) *Attorney, Agent, or Firm*—Meroni & Meroni, P.C.; Charles F. Meroni, Jr.; Christopher J. Scott

(57) ABSTRACT

A receptacle shroud and shroud removal tool coact to selectively restrict unauthorized access to a channel-bound electrical receptacle. The receptacle shroud comprises a channel-engaging wall and a receptacle cover. The receptacle cover comprises a tool-receiving aperture. The channel-engaging wall is sized and shaped for snug insertion in a pedestal-bounding, structure-receiving channel. The channel-engaging wall is retained by friction forces at shroud-to-channel interfacing. The shroud removal tool comprises a shroud-engaging end and a handle end. The shroud-engaging end is insertable through the tool-receiving aperture. The handle end enables a user to manually impart shroud-removing forces to the shroud-engaging end, which shroud-engaging end transfers the shroud-removing forces to the receptacle shroud. The shroud-removing forces are operable to remove the channel-engaging wall from the structure-receiving channel.

24 Claims, 23 Drawing Sheets

U.S. PATENT DOCUMENTS

| | | | | |
|---|---|---|---|---|
| 7,026,550 | B2 | 4/2006 | McBain | |
| 7,056,145 | B2 * | 6/2006 | Campbell et al. | 439/373 |
| 7,094,969 | B1 | 8/2006 | In | |
| 2002/0162682 | A1 | 11/2002 | Victor | |
| 2004/0014340 | A1 * | 1/2004 | Vargas et al. | 439/135 |
| 2004/0074663 | A1 | 4/2004 | Broussard, Jr. | |
| 2004/0092150 | A1 | 5/2004 | Kobayshi | |
| 2005/0161249 | A1 | 7/2005 | McBain | |
| 2005/0287851 | A1 | 12/2005 | Earl | |
| 2006/0021780 | A1 * | 2/2006 | Hill | 174/67 |
| 2006/0180334 | A1 | 8/2006 | McBain | |

* cited by examiner

DEVICE FOR RESTRICTING UNAUTHORIZED ACCESS TO ELECTRICAL RECEPTACLES

BACKGROUND OF THE INVENTION

1. Field of the Invention

The disclosed invention generally relates to a device for restricting access to electrical receptacles. More particularly, the disclosed invention relates to a receptacle shroud and shroud removal tool for restricting unauthorized access to computer cabinet power strip-based electrical receptacles and/or power distribution unit (PDU) electrical receptacles.

2. Brief Description of the Prior Art

Unrestricted access to electrical receptacles is a prevalent problem. In the context of computers and other highly specialized machinery requiring power inputs within highly specific parameters, unrestricted access to peripheral electrical receptacles poses a great potential for damage to the equipment on the one hand, and a great potential for costly power shrinkage on the other hand. A number of attempts have been made to develop means to restrict access to electrical receptacles. Some of the more pertinent art relating to means for restricting access to electrical receptacles and the like are briefly described hereinafter.

U.S. Pat. No. 2,119,428 ('428 patent), which issued to Englar, discloses a Protective Electrical Receptacle Plate. The '428 patent teaches a protective device which is a separate unit to be mounted over electrical outlets; said protective device consisting of a rotatable insulated disc, of sufficient size to cover surface area of electrical outlet unit; said disc having plug openings, adapted by a turning movement to be brought into alignment with fixed electrical contact chambers in the usual electric outlet; an axis or pin on which said disc may rotate; yieldable blocking and locking means between said rotatable disc and surface area of electric outlet unit, to definitely lock said disc, said locking means being yieldable only by the pressure of simultaneous plug; means to automatically return said rotatble disc into normal locked position when standard electric plug prongs are removed from contact chambers, definitely closing said electric contact chambers when not in use.

U.S. Pat. No. 4,970,349 ('349 patent), which issued to Jones, discloses a Safety Outlet Cover Assembly. The '349 patent teaches a safety outlet cover assembly for preventing unauthorized access to a wall socket outlet. The safety outlet assembly comprises a housing, a plug insertion guard assembly disposable within the housing, and a key member for selectively engaging the plug insertion guard assembly to move the plug insertion guard assembly from a first position and a second position. In the first position the plug insertion guard assembly is in a blocking position relative to openings in the housing and thus the wall socket outlet; whereas, when the plug insertion guard assembly is in the second position, access to the wall socket outlet is unrestricted so that male components of an electrical plug can be inserted into female openings of a wall socket to complete the electrical circuit therebetween.

U.S. Pat. No. 5,243,135 ('135 patent), which issued to Shotey, discloses an Electrical Outlet Cover Lock. The '135 patent teaches an electrical outlet cover having a tang protruding therefrom and pivotally attached to a mounting plate of an electrical outlet to interconnect with and lockingly engage a lip extending from the mounting plate. A key, insertable through a keyway in the bottom side of the cover, is used to force the tang upwardly out of engagement with the lip and to unlock the cover from the mounting plate. Subsequent downward pivotal movement of the cover toward the mounting plate will relock the cover.

U.S. Pat. No. 5,813,873 ('873 patent), which issued to McBain et al., discloses an Electrical Outlet Safety Cover. The '873 patent teaches a safety cap for an electrical outlet having an adhesive section that can be attached to a standard outlet cover. Alternately an outlet cover including two slidable plates including a spring or spring groove can be used to prevent access to the outlet by a child. An elongated member on one plate is used to contact a spring on the other plate. Alternately, the elongated member can fit into a spring groove to bias the plates apart into the closed position. Locking pins can be used to lock the plates onto an aperture at the base of a plug's power prong. Additionally, a recess around each electrical outlet can mate with a respective lip of a plug to provide an interlocking interface between the plug and outlet cover to prevent a child from being able to insert a metal object between the plug and the face-plate.

U.S. Pat. No. 5,866,847 ('846 patent) which issued to Huag, discloses a Safety Electrical Outlet. The '846 patent teaches a safety electrical outlet including a plurality of raised socket bodies with a respective pair of blade insertion slots for receiving metal contact blades of an electrical plug, a plurality of rotary safety socket covers respectively covered on the socket bodies and revolvably supported thereon, each rotary safety socket cover having two blade insertion slots for receiving metal contact blades of an electrical plug, and a plurality of spiral springs connected between the socket bodies and the rotary safety socket covers to hold the respective socket covers in a sealing position in which the blade insertion slots of the rotary safety socket covers are retained out of alignment with the blade insertion slots of the respective socket bodies.

U.S. Pat. No. 6,310,291 ('291 patent) which issued to Clough, discloses a Utility Lock-Out Apparatus. The '291 patent teaches a utility lock-out apparatus for power outlet assemblies, electrical switch assemblies, communication outlet assemblies, cable outlet assemblies, or the like. The utility lock-cut apparatus may be configured in the form of a power outlet face plate, an electrical switch face plate, a communication outlet face plate, a cable outlet face plate. The utility lock-out apparatus may also be configured in the form of an attachment to a conventional power outlet face plate, a conventional electrical switch face plate, a conventional communication outlet face plate, or a conventional cable outlet face plate, wherein the particular utility lock-out face plate or attachment includes a base element and at least one longitudinal element that extends from the surface of the base element at a particular location for a desired distance above the surface of the base element. Each longitudinal element includes a hole defined therein having a size configured for enabling a lock bar to pass therethrough. The particular utility lock-out face plate or attachment provides the ability of a user to lock-out access to one or more power outlets, electrical switches, communication outlets, or cable outlets.

U.S. Pat. No. 6,342,676 ('676 patent), which issued to Ha, discloses a Safety Guard Device for Electrical Wall Outlet. The '676 patent teaches a safety guard device for an electrical outlet provided with a base plate adapted to be fixed to an electrical receptacle containing at least one aperture for registry with the electrical receptacle, and a cover plate in slidable engagement with the base plate for covering the base plate, and thus access to the electrical receptacle. A locking device is provided between the base plate and the cover plate for locking the plates relative to each other. The locking device includes slots provided in the cover plate and locking protrusions provided in the base plate for engaging in the slots when the cover plate is closed. The cover plate is also provided with lateral protrusions in close proximity to the slot in the cover plate for guiding the base plate in the slots of the cover plate. Preferably, the cover plate is of a sufficient weight to self-lock in a sliding motion when unobstructed by any electrical device plugged into the receptacle in order to provide a safe, locked receptacle assembly.

U.S. Pat. No. 6,533,598 ('598 patent), which issued to Bentley et al., discloses a Lockable Wall Outlet Electrical Receptacle. The '598 patent teaches a lockable wall outlet electrical receptacle having a housing with a pair of vertically spaced electrical plug aperture set formed in its front wall surface. The housing would be made of a plastic material that is electrically nonconductive. There are chambers and channels in the structure of the housing for receiving the left blade prong terminal, the right blade prong terminal and the ground prong terminal for each of the respective sets electrical plug apertures. The rear end of the respective prong terminals are electrically connected to electrical wire connection terminals on the outer surface of the housing. An upper and a lower shaft have their front ends extending outwardly from the left side wall surface of the housing. The shafts have structure formed in their peripheral surface that allows a predetermined number of degrees of rotation to lock the blade prongs of a male electrical plug in the wall outlet receptacle after they have been inserted into the electrical plug apertures. A mechanical structure having a lever arm for actuation connects the respective upper and lower shaft members so that they would be rotated at the same time.

U.S. Pat. No. 7,094,969 ('969 patent), which issued to In, discloses an electrical outlet safety cover which is provided that includes a sliding cover plate and spring-loaded catches to limit children's access to electrical outlets but to offer quick and easy access to users. The base plate on the safety cover replaces a conventional electrical outlet plate. It includes apertures for electrical outlets and for an attaching screw, and a top panel with two catches and a slot for an opposing catch. The vertical sides of the base plate fit into matching grooves on the vertical sides of a cover plate, which also includes a catch and slots for the catches on the base plate. When the catches are released, the cover plate can thus slide down the base plate, revealing the electrical outlets for use. To prevent access to the outlets, the cover plate can be slid up the base plate until all three catches securely lock.

United States Patent Application Publication No. 2002/0162682 which was authored by Victor, teaches a system which allows for a face plate to be locked to an electrical box. The system has a male connector which is rotatably coupled to the face plate. A female receptacle receives the male connector. A partial turn of the male connector will lock and unlock the face plate to the electrical box.

From a consideration of the foregoing disclosures, it will be seen that the prior art fails to disclose a receptacle shroud that is frictionally receivable in a receptacle-bounding channel. It will be further seen that that prior art fails to teach a shroud of the foregoing type that comprises means for preventing pincer-enabled removal of the shroud from the shroud-receiving channel, and which shroud is cooperable with a specialized tool, held by authorized personnel, for selectively removing the shroud from the shroud-receiving/retaining channel and allowing access to the underlying electrical receptacle. The prior art thus perceives a need for a shroud of this type, which shroud may well be outfitted upon power strip-based electrical receptacles and thereby selectively restrict access to the underlying electrical receptacle(s).

SUMMARY OF THE INVENTION

It is thus an object of the present invention to provide a device or tool kit for selectively outfitting power strips and the like for restricting unauthorized access to a channel-bound electrical receptacle. It is contemplated that the tool kit of the present invention may be said to essentially comprise a receptacle shroud and a shroud removal tool, the two working concert for selectively restricting access to the receptacle.

The receptacle shroud essentially comprises a channel-engaging wall and an access-restrictive dome or receptacle cover. The channel-engaging wall comprises an inner wall surface, an outer wall surface, and a substantially uniform wall thickness. The access-restrictive dome comprises a tool-receiving aperture. The channel-engaging wall is sized and shaped for snug or frictional insertion in a structure-receiving channel, which structure-receiving channel bounds a receptacle or receptacle pedestal. The channel-engaging wall, after being frictionally inserted into the structure-receiving channel, is retainable by friction forces at shroud-to-channel interfacing.

The shroud removal tool comprises a shroud-engaging end and a handle end. The shroud-engaging end is insertable through or otherwise cooperable with the tool-receiving aperture or structure of the access-restrictive dome. The handle end enables a user to manually impart shroud-removing forces to the shroud-engaging end. The shroud-engaging end transfers the shroud-removing forces to the receptacle shroud and is operable to remove the channel-engaging wall from frictional engagement with the structure-receiving channel.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings:

FIG. 25 is juxtaposed adjacent FIG. 24 for clarity of reference.

DETAILED DESCRIPTION OF THE PREFERRED EMBODIMENT(S)

Figure 1:
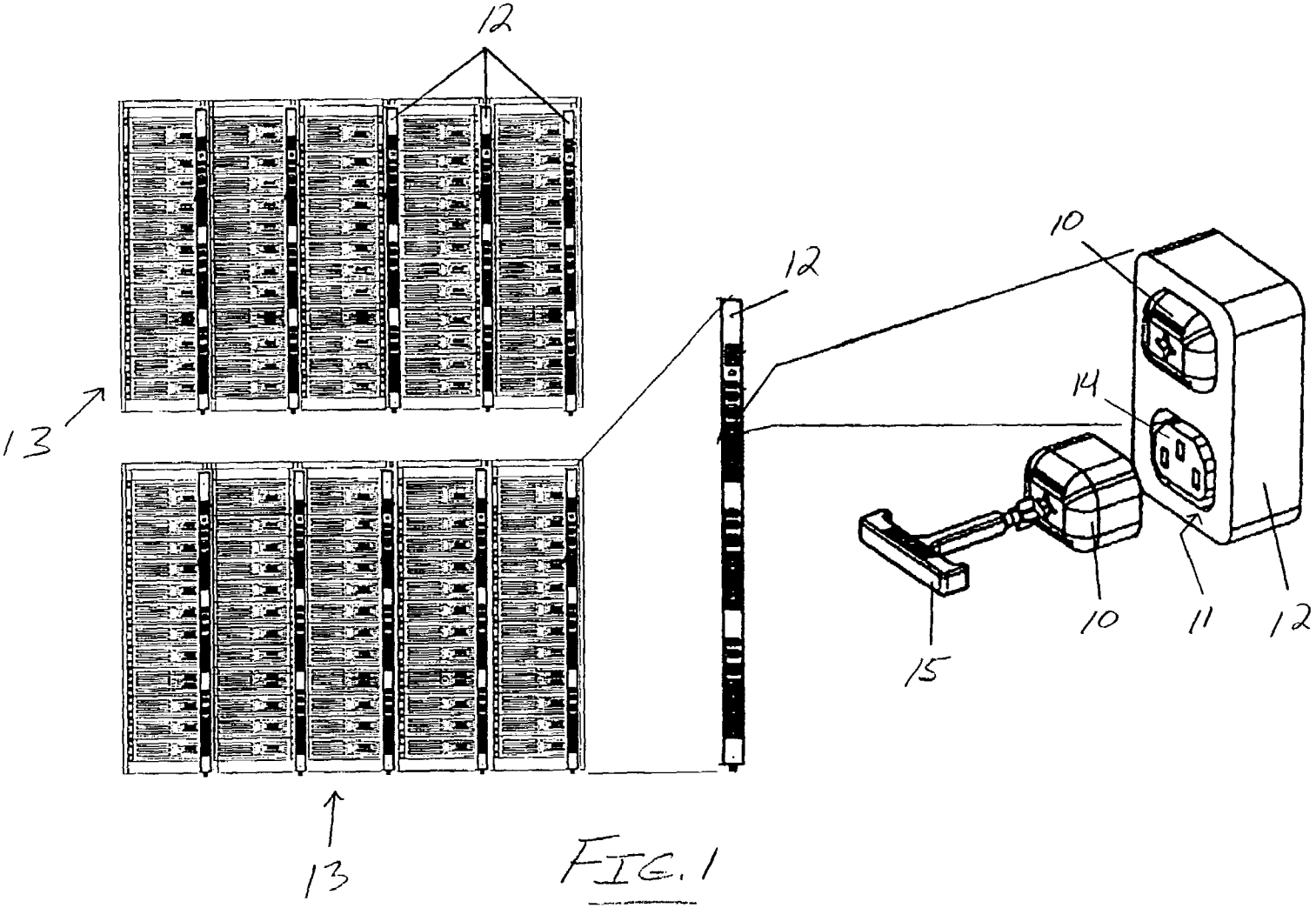
FIG. 1 is a perspective exploded type depiction of a receptacle shroud and shroud removal tool of the present invention juxtaposed adjacent a fragmentary portion of a power strip as enlarged from a full power strip depiction, which full power strip depiction is enlarged from a computer cabinet depiction.
Figure 2:
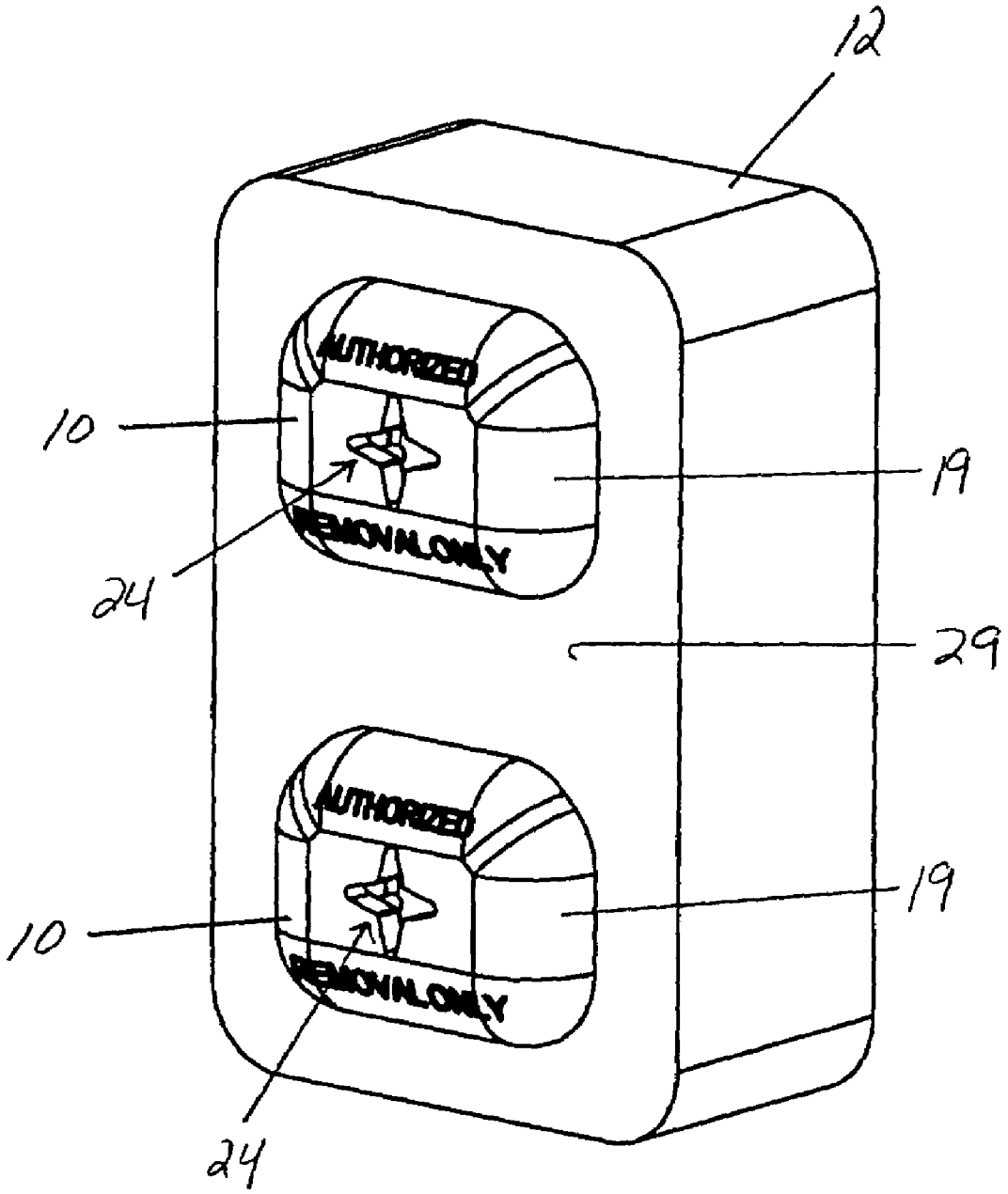
FIG. 2 is an anterior perspective view of a first alternative embodiment of two receptacle shrouds of the present invention in access-restricting assembled relation relative to two electrical receptacle sites.
Figure 3:
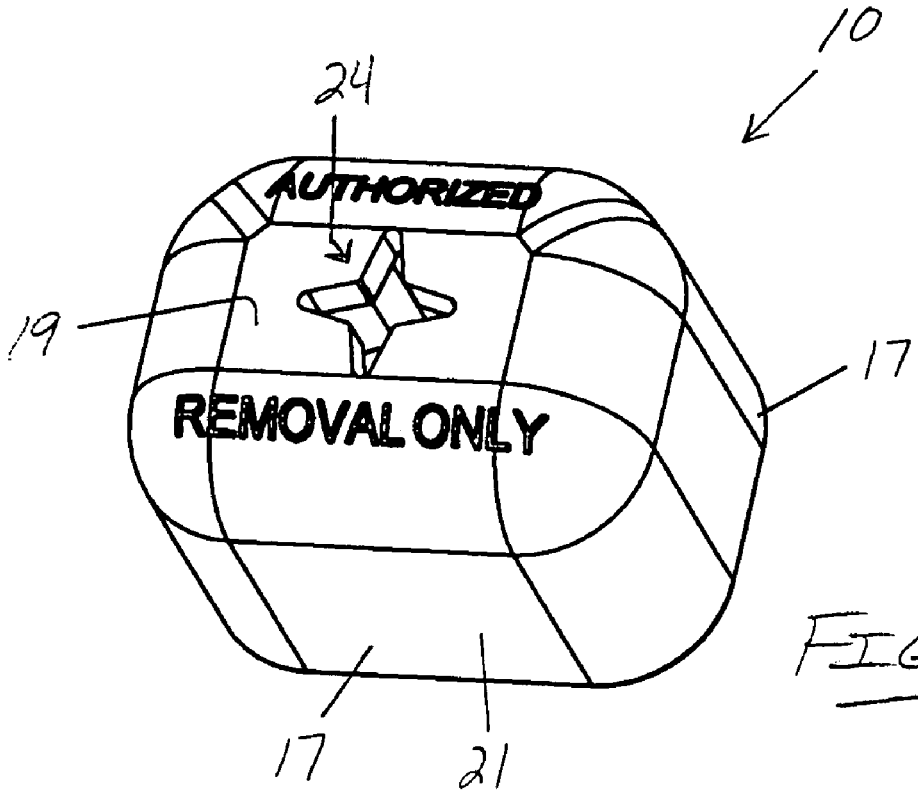
FIG. 3 is an anterior perspective view of the first alternative embodiment of the receptacle shroud of the present invention.
Figure 4:
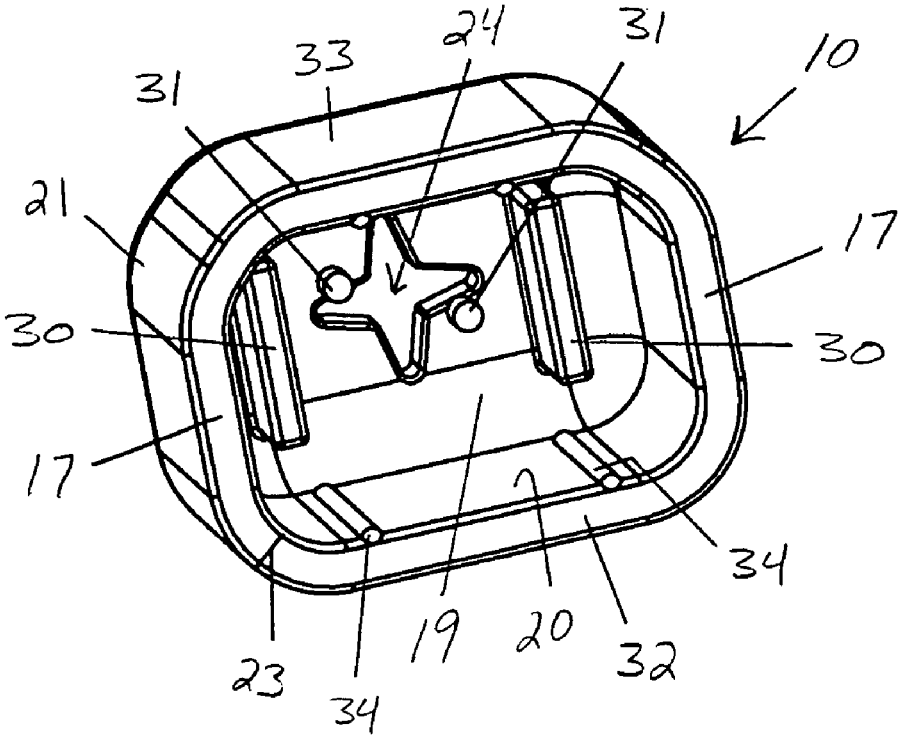
FIG. 4 is a posterior perspective view of the first alternative embodiment of the receptacle shroud of the present invention otherwise depicted in FIG. 3.

The International Electrotechnical Commission (IEC) governs or oversees strict international standardization for electrical, electronic and related technologies. Some of its standards are developed jointly with the International Organization for Standardization (ISO). IEC C320 plugs and receptacles, for example, should conform to the requirements of the IEC 60320 standard. In this regard, it should be noted that the noted standard defines certain performance parameters including the minimum and maximum permitted levels of force required to withdraw a plug from a receptacle. The minimum withdrawal force requirement required by the standard is 10 N (newtons) and the maximum withdrawal force requirement required by the standard is 50 N. The preferred embodiments of the present invention essentially set forth tool-removable receptacle shrouds 10 that are frictionally retained in receptacle channels or shroud-receiving channels 11 of power strips and/or surge strips 12 that typically accompany computer cabinetry 13. The receptacle shrouds 10 of the present invention have been designed to conform to the foregoing standards.

Referring now to the drawing with more specificity, the present invention generally concerns a tool-removable receptacle shroud 10 as modeled or presented in first and second alternatives. The tool-removable receptacle shroud 10 of the present invention is generally illustrated and referenced in FIGS. 1-4, 8-15, 19-23, and 26-29. It is contemplated that the first alternative of the receptacle shroud 10 is designed for use in conjunction with a C13 type receptacle. In other words, the first alternative of the receptacle shroud 10 may well function to shroud or restrict access to a C13 type receptacle or receptacle pedestal 14. Further, it is contemplated that the second alternative of the receptacle shroud 10 may well function to shroud or restrict unauthorized access to a C19 type receptacle or receptacle pedestal 14. The first alternative of the receptacle shroud 10 is generally depicted in FIGS. 1-4, 8-12, 26, and 27 and the second alternative of the receptacle shroud 10 is generally depicted in FIGS. 13-15, 19-23, 28, and 29. The target receptacle or receptacle pedestal 14 of the present invention, as exemplified by a C13 type receptacle pedestal and a C19 type receptacle pedestal are generally illustrated and referenced in FIGS. 1, 5-7, 12, 24, and 25 (C13 type receptacle pedestal 14) and FIGS. 16-18, and 23 (C19 type receptacle pedestal 14).

Figure 5:
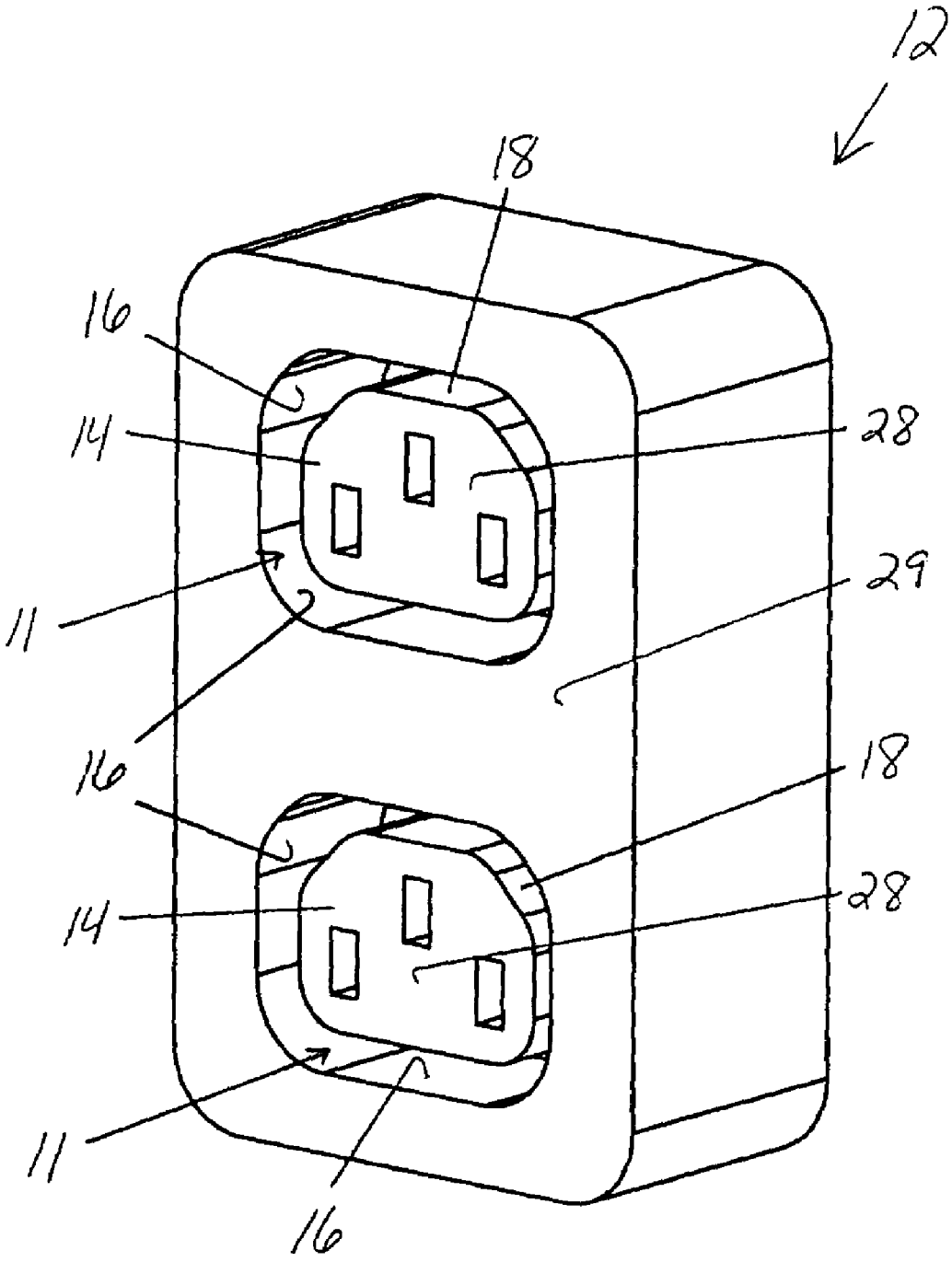
FIG. 5 is an anterior perspective view of two C13 type electrical receptacle sites each depicting a shroud-receiving channel bounding respective receptacle pedestals for receiving two receptacle shrouds of the first alternative embodiment.
Figure 6:
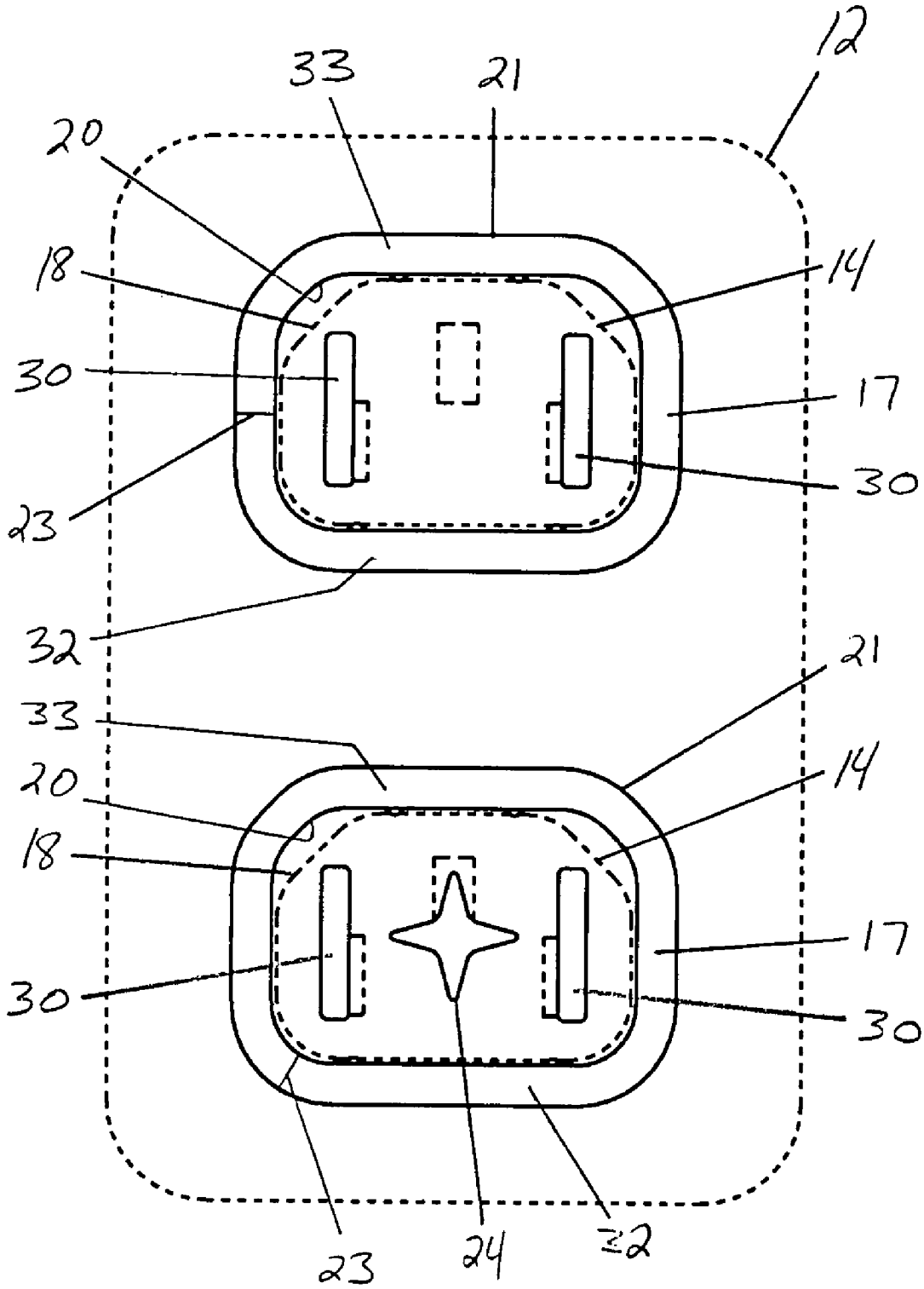
FIG. 6 is a fragmentary sectional view of upper and lower first alternative receptacle shroud features as positioned relative to a phantom power strip and phantom receptacle pedestal structure, the upper receptacle shroud features being receptacle cover spacing structure and a channel-engaging wall and the lower receptacle shroud features being receptacle cover spacing structure, a star-shaped tool-receiving aperture, and a channel-engaging wall.
Figure 7:
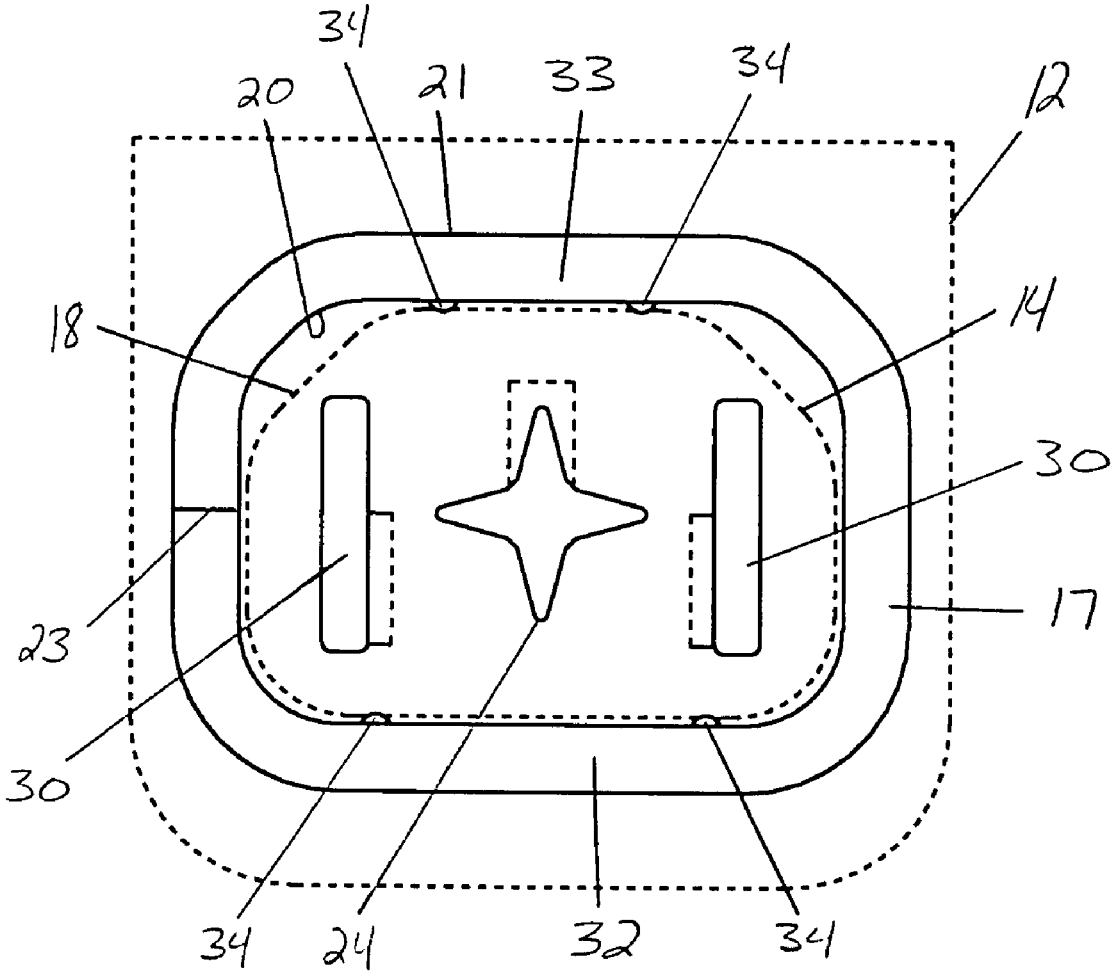
FIG. 7 is a fragmentary sectional view of the lower receptacle shroud otherwise shown in FIG. 6 depicting the receptacle shroud frictionally received in a shroud-receiving channel with certain receptacle cover spacing structure and a star-shaped tool-receiving aperture.
Figure 8:
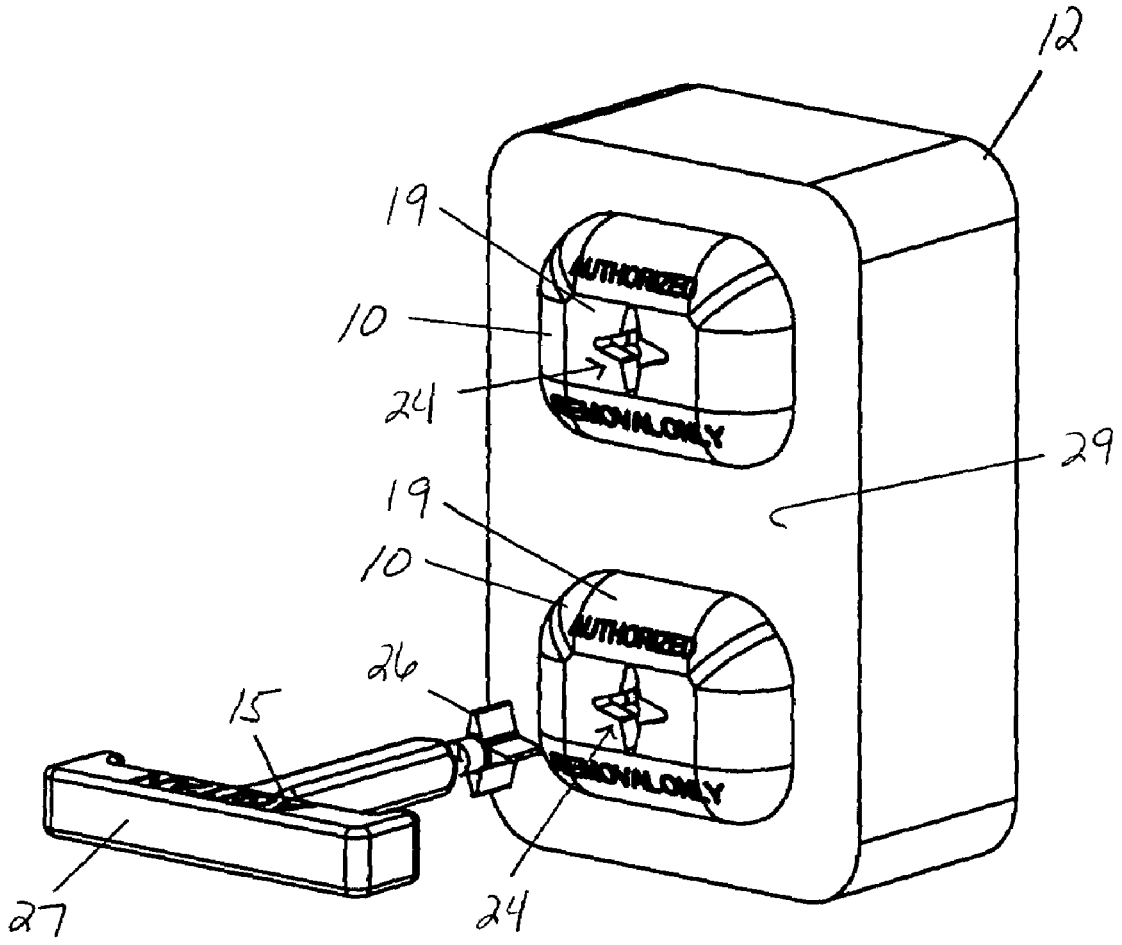
FIG. 8 is an anterior perspective exploded type depiction of a shroud removal tool juxtaposed adjacent the assemblage otherwise depicted in FIG. 2.
Figure 9:
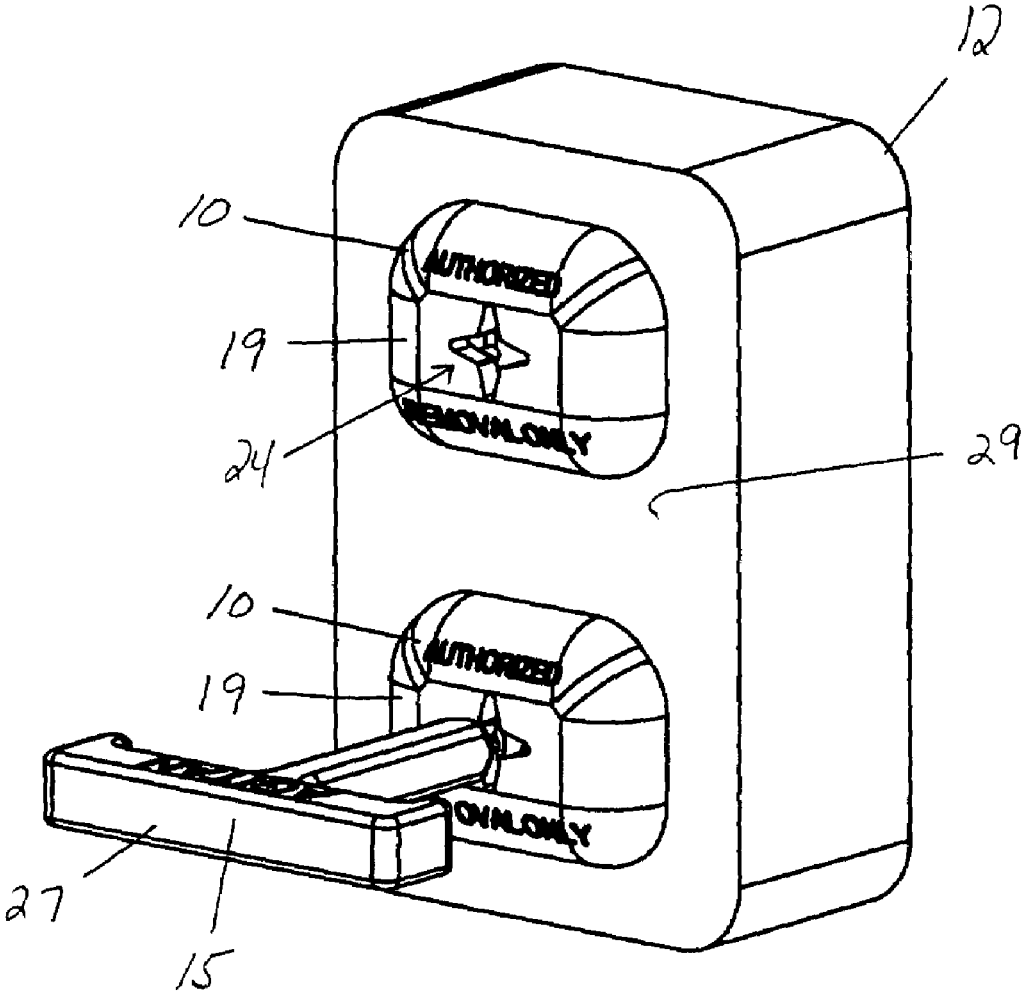
FIG. 9 is an anterior perspective depiction of a shroud-engaging end of the shroud removal tool otherwise show in FIG. 8 being inserted into the tool-receiving aperture of a lower receptacle shroud.
Figure 10:
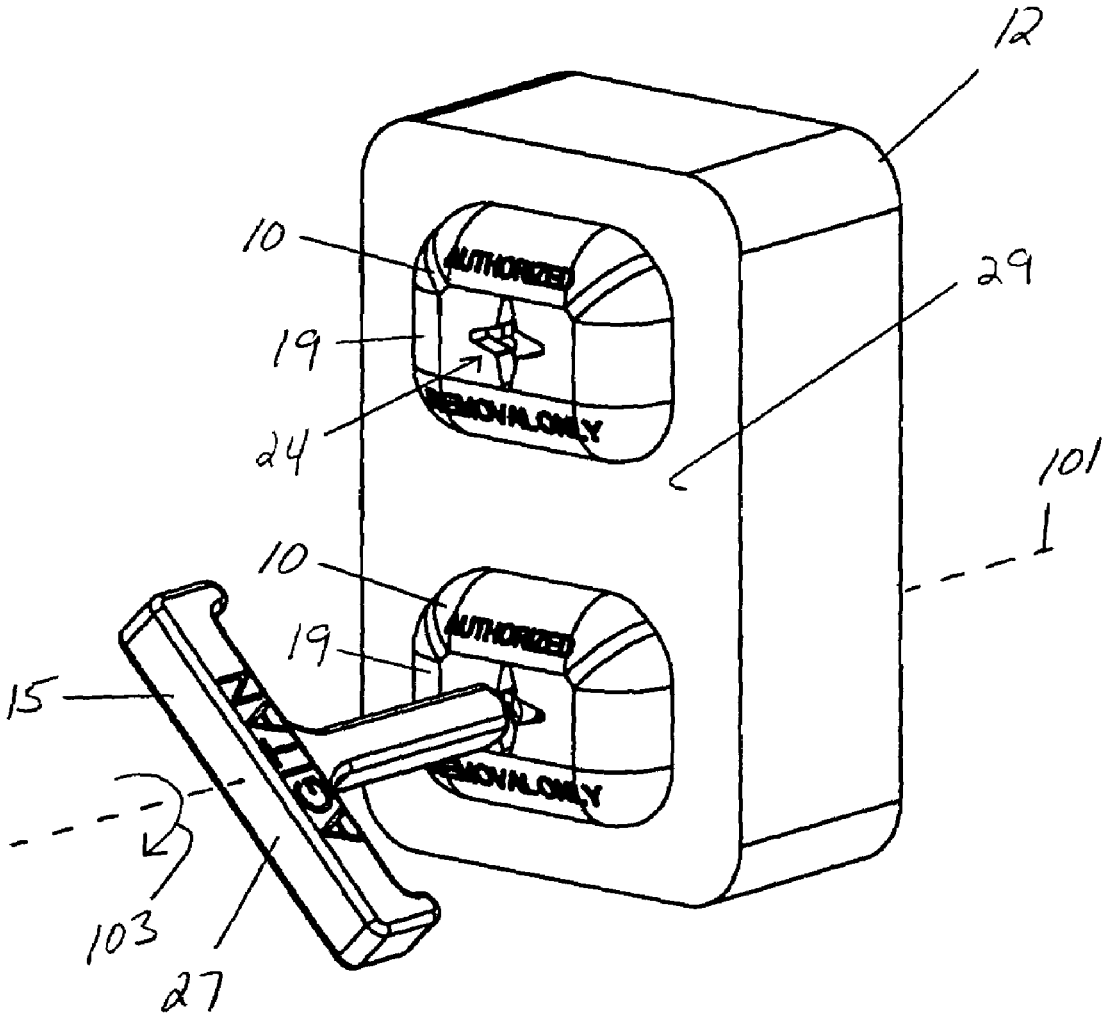
FIG. 10 is an anterior perspective depiction of the shroud removal tool otherwise shown in FIG. 9 being rotated about a tool axis of rotation.
Figure 11:
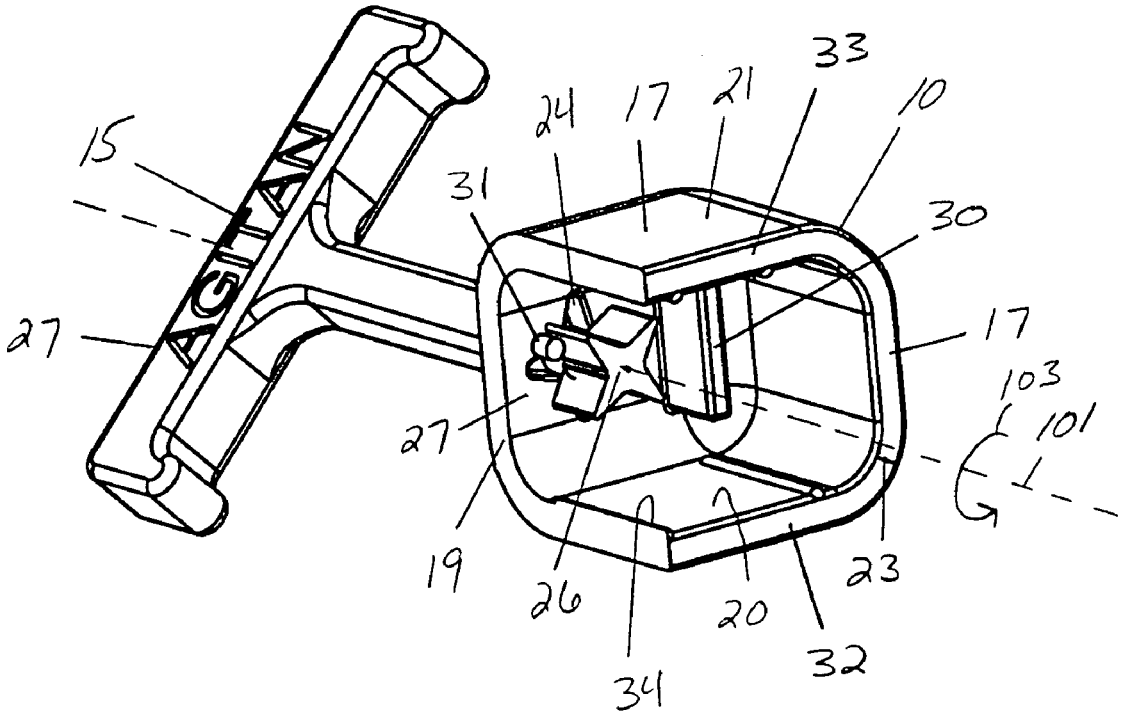
FIG. 11 is a posterior perspective depiction of the shroud removal tool otherwise shown in FIG. 10 being rotated about the tool axis of rotation with the shroud-engaging end engaging a posterior bearing surface of a fragmentary receptacle shroud.
Figure 12:
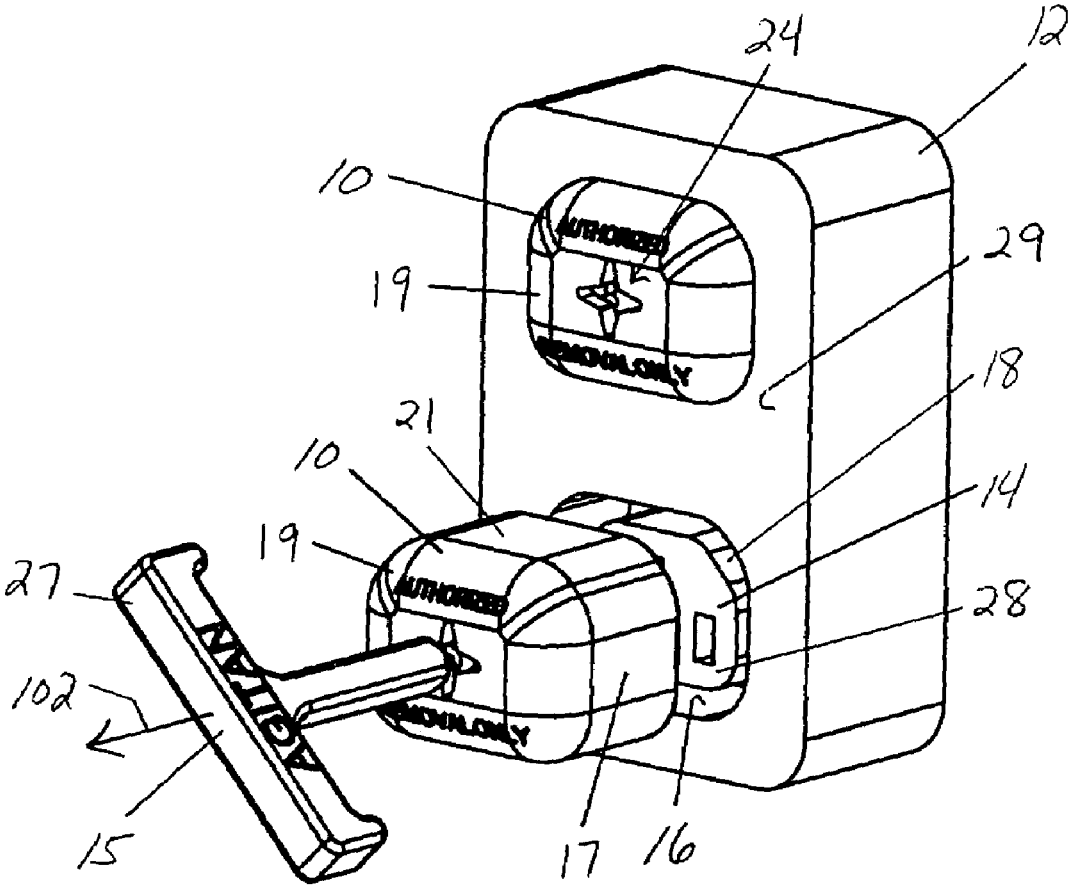
FIG. 12 is an anterior perspective depiction of the shroud removal tool otherwise shown in FIG. 9 removing the receptacle shroud from frictional engagement with the shroud-receiving channel of the lower electrical receptacle site.
Figure 13:
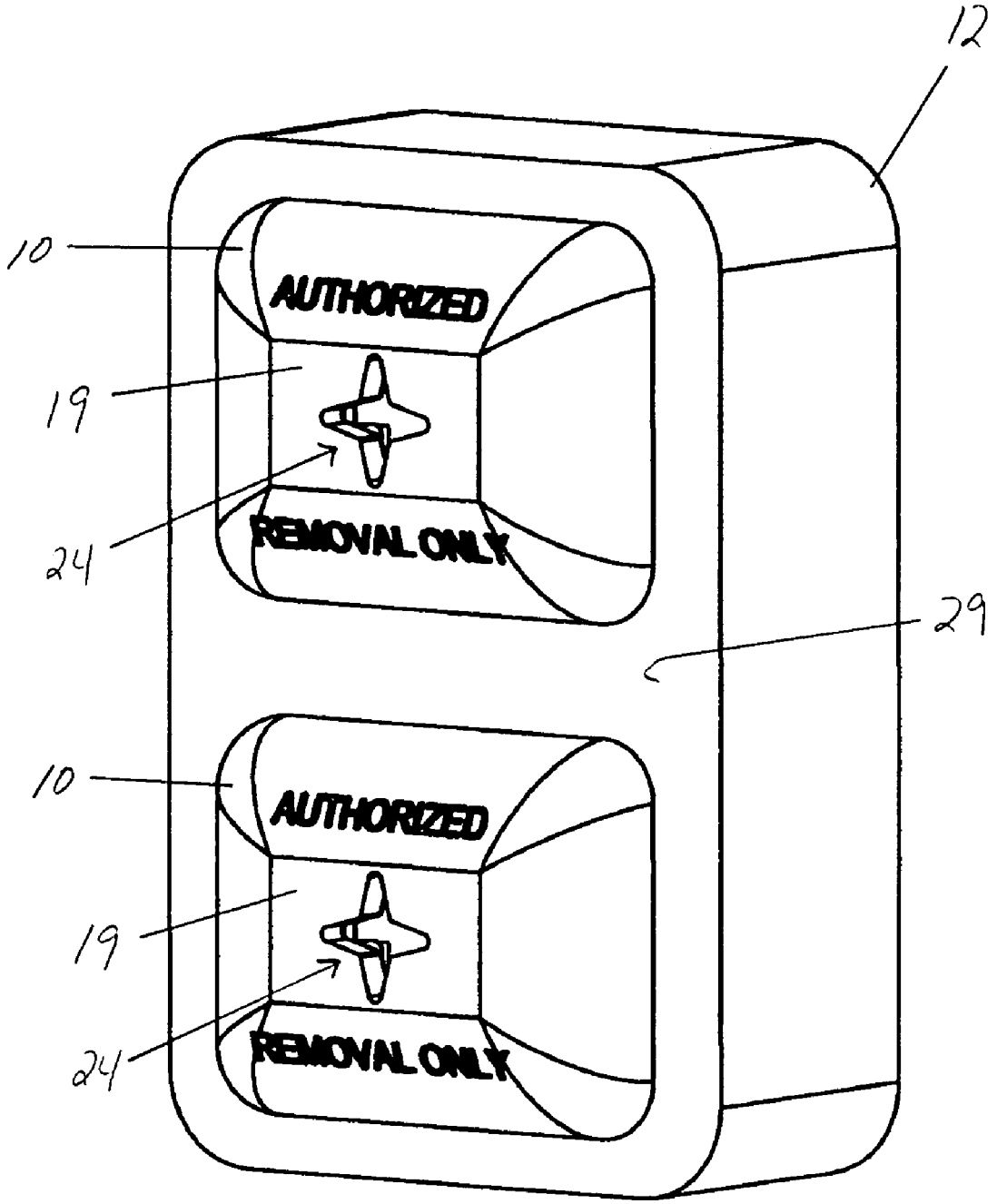
FIG. 13 is an anterior perspective view of a second alternative embodiment of two receptacle shrouds of the present invention in access-restricting assembled relation relative to two electrical receptacle sites.
Figure 14:
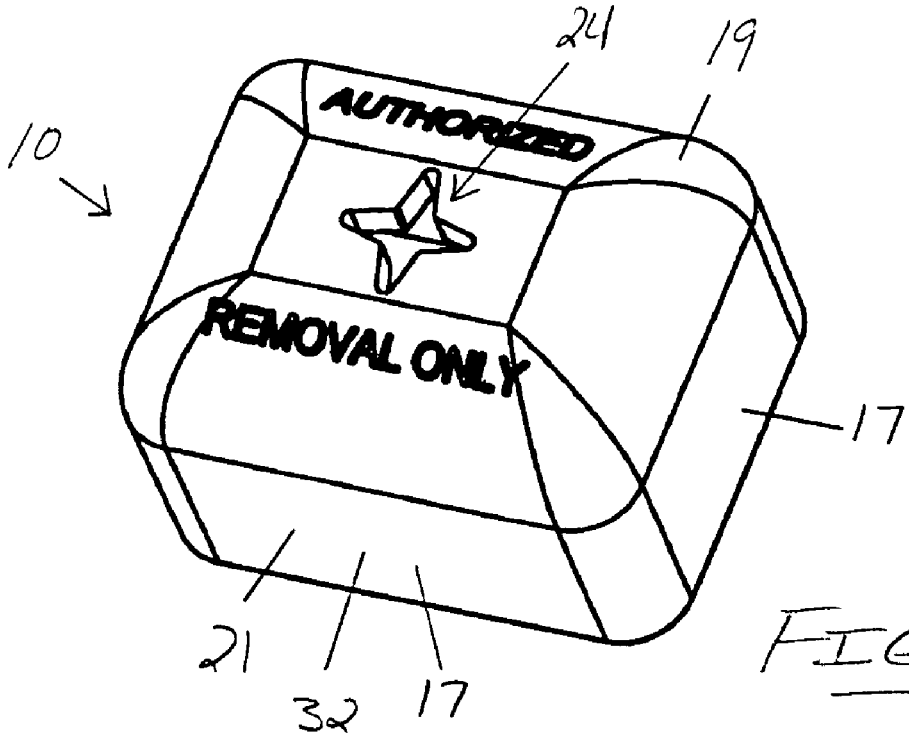
FIG. 14 is an anterior perspective view of the second alternative embodiment of the receptacle shroud of the present invention.
Figure 15:
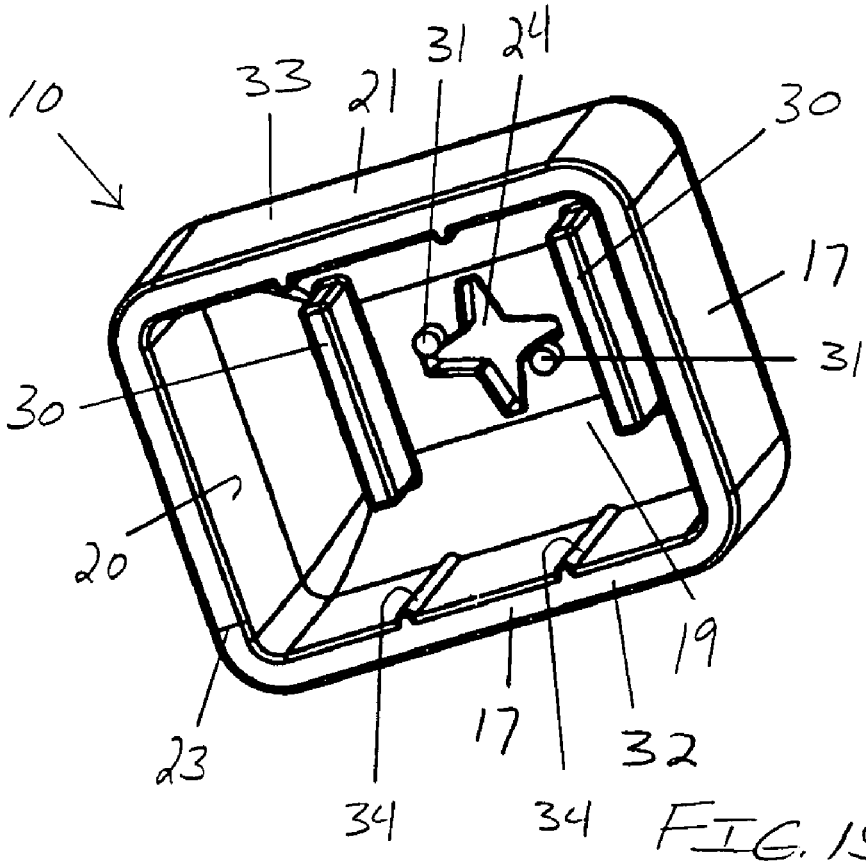
FIG. 15 is a posterior perspective view of the second alternative embodiment of the receptacle shroud of the present invention otherwise depicted in FIG. 14.
Figure 16:
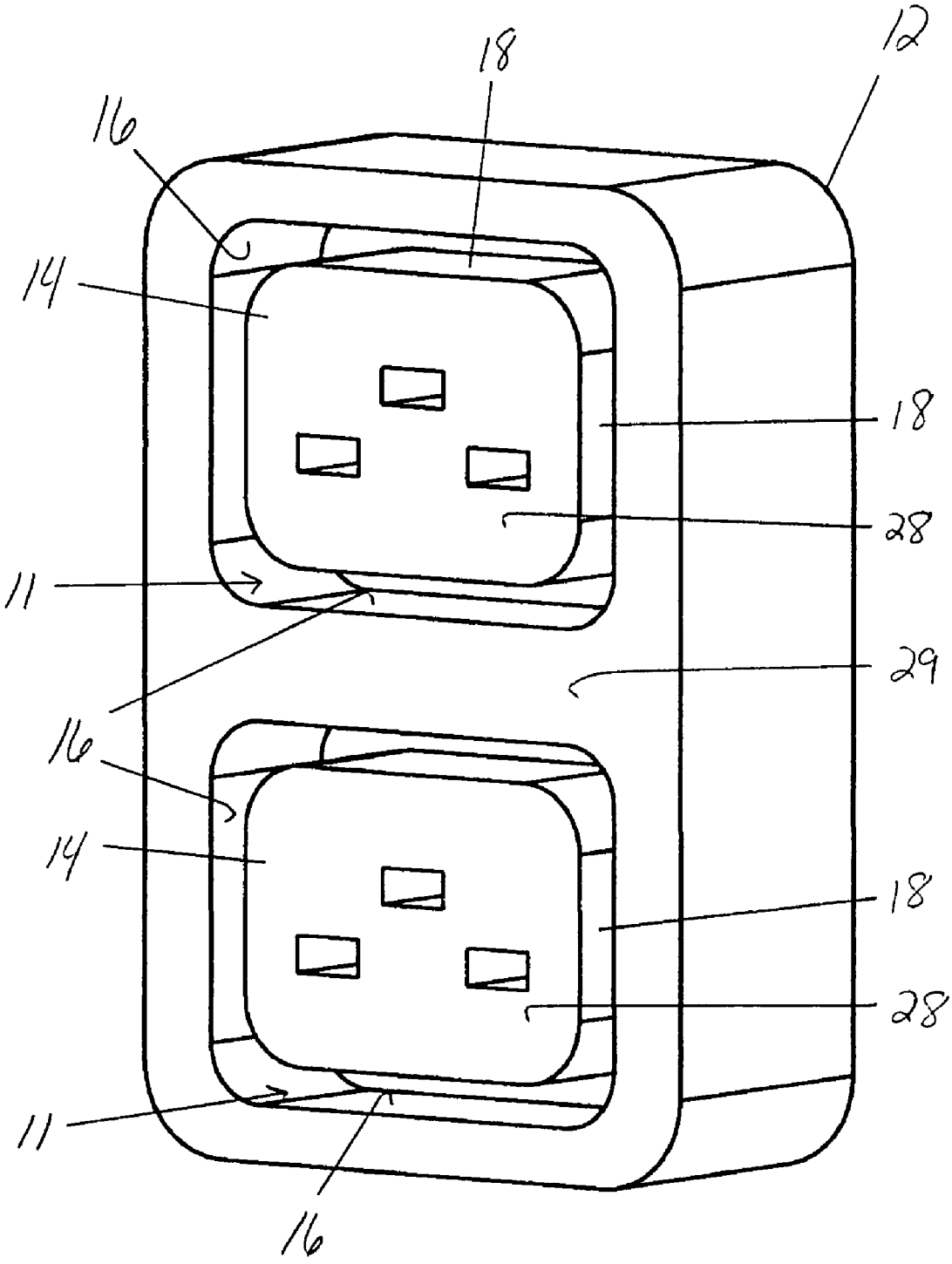
FIG. 16 is an anterior perspective view of two C19 type electrical receptacle sites each depicting a shroud-receiving channel bounding respective receptacle pedestals for receiving two receptacle shrouds of the second alternative embodiment.
Figure 17:
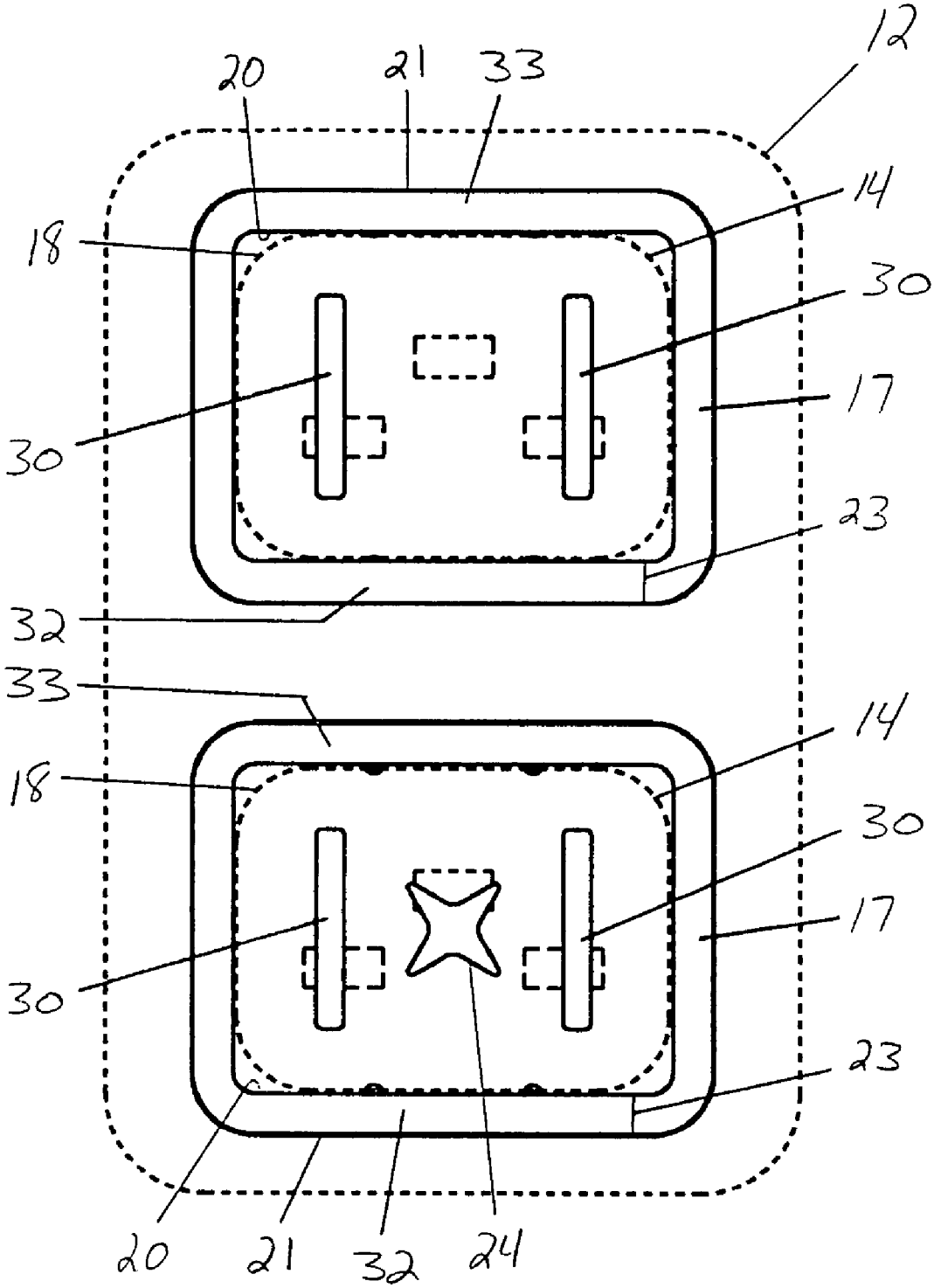
FIG. 17 is a fragmentary sectional view of upper and lower second alternative receptacle shroud features as positioned relative to a phantom power strip and phantom receptacle pedestal structure, the upper receptacle shroud features being receptacle cover spacing structure and a channel-engaging wall and the lower receptacle shroud features being receptacle cover spacing structure, a star-shaped tool-receiving aperture, and a channel-engaging wall.
Figure 18:
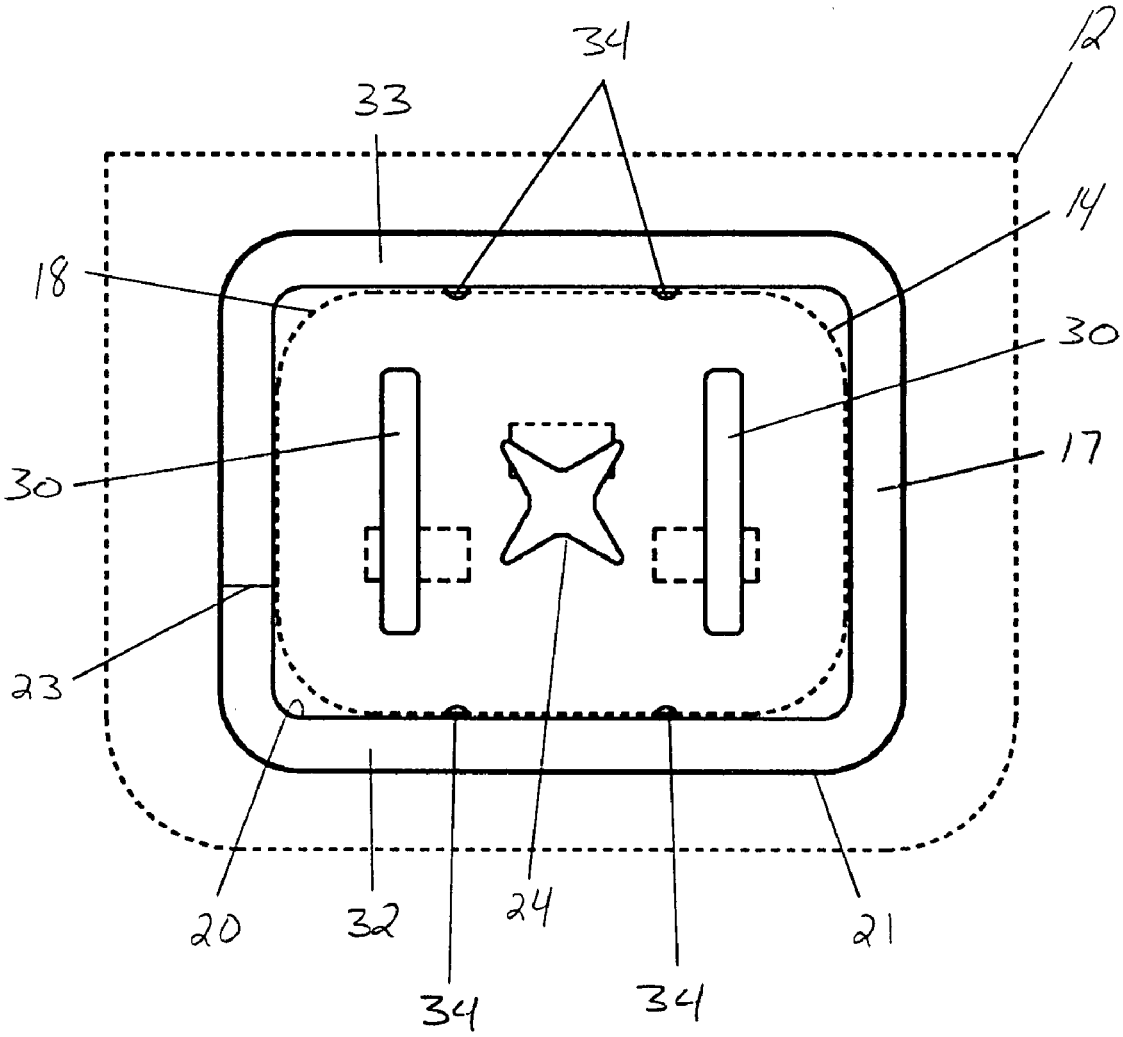
FIG. 18 is a fragmentary sectional view of the lower receptacle shroud otherwise shown in FIG. 17 depicting the same frictionally received in a shroud-receiving channel with certain receptacle cover spacing structure and a star-shaped tool-receiving aperture.
Figure 19:
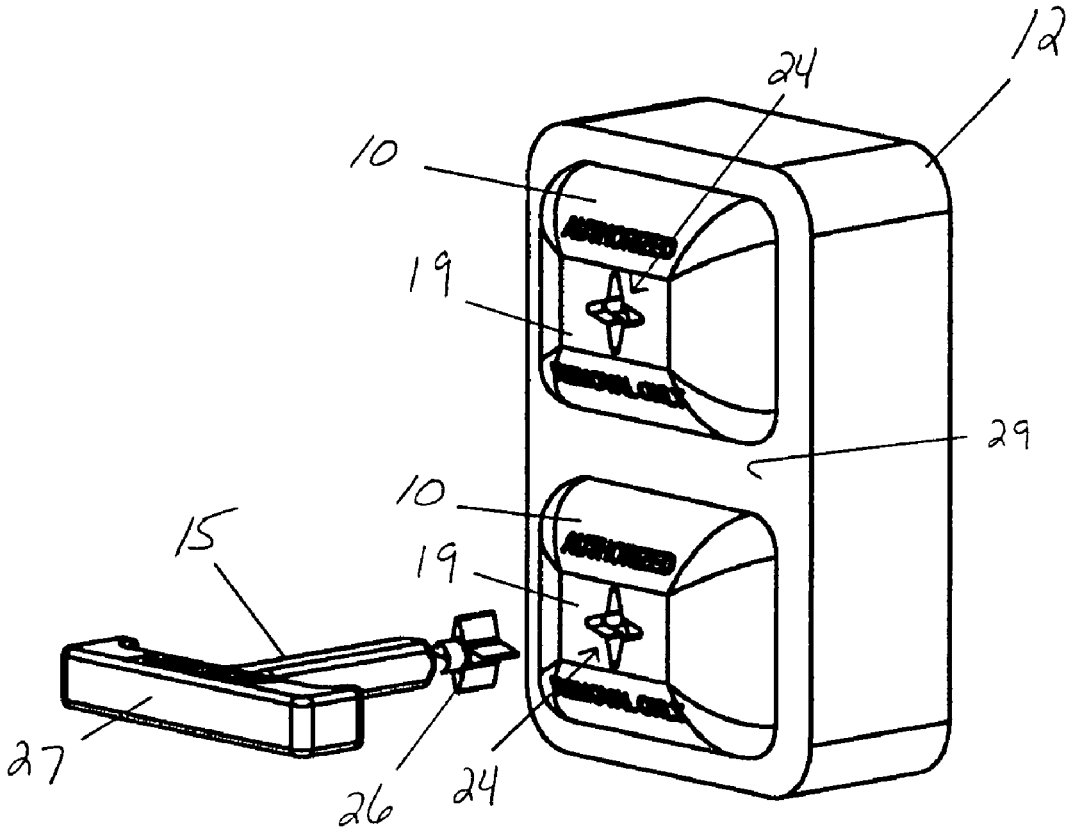
FIG. 19 is an anterior perspective exploded type depiction of a shroud removal tool juxtaposed adjacent the assemblage otherwise depicted in FIG. 13.
Figure 20:
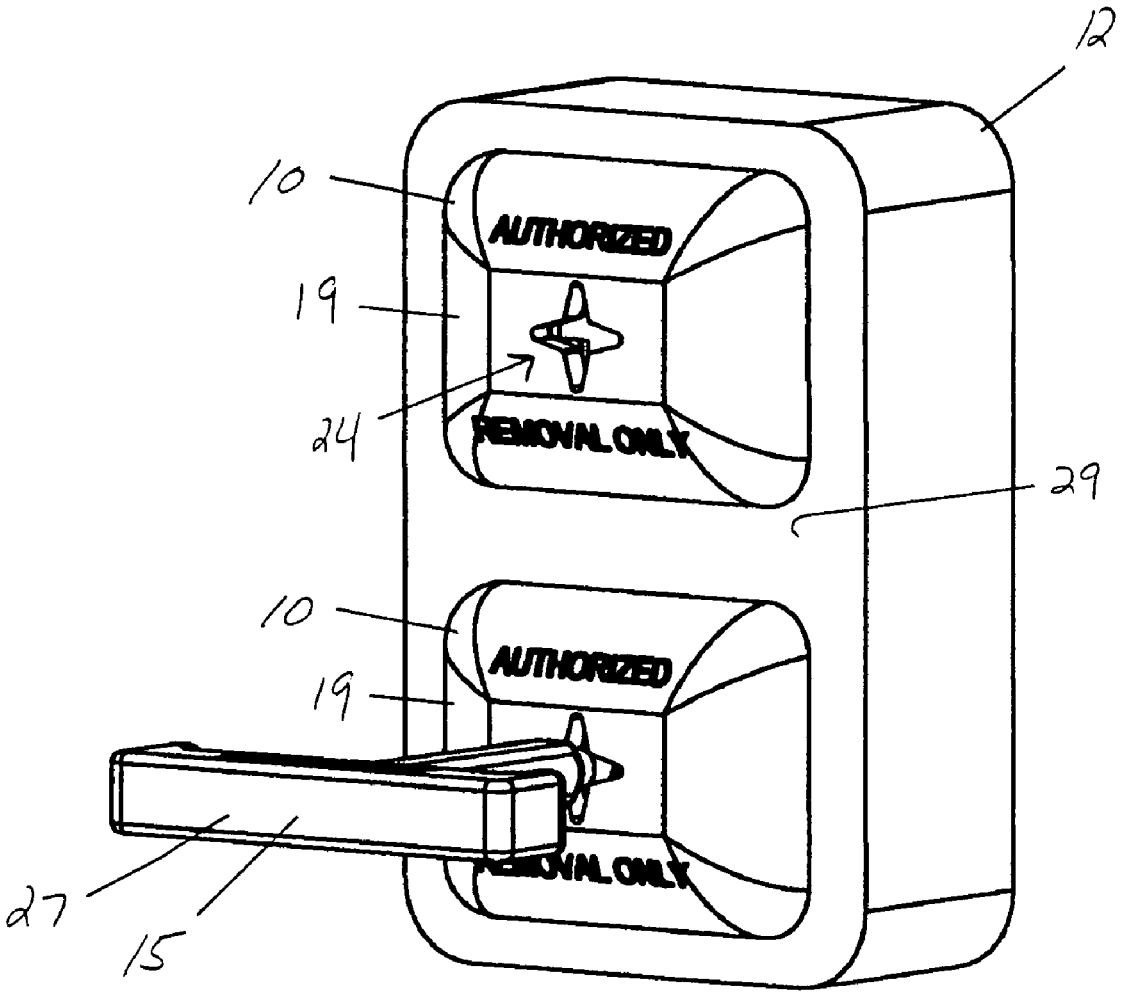
FIG. 20 is an anterior perspective depiction of a shroud-engaging end of the shroud removal tool otherwise show in FIG. 19 being inserted into the tool-receiving aperture of a lower receptacle shroud.
Figure 21:
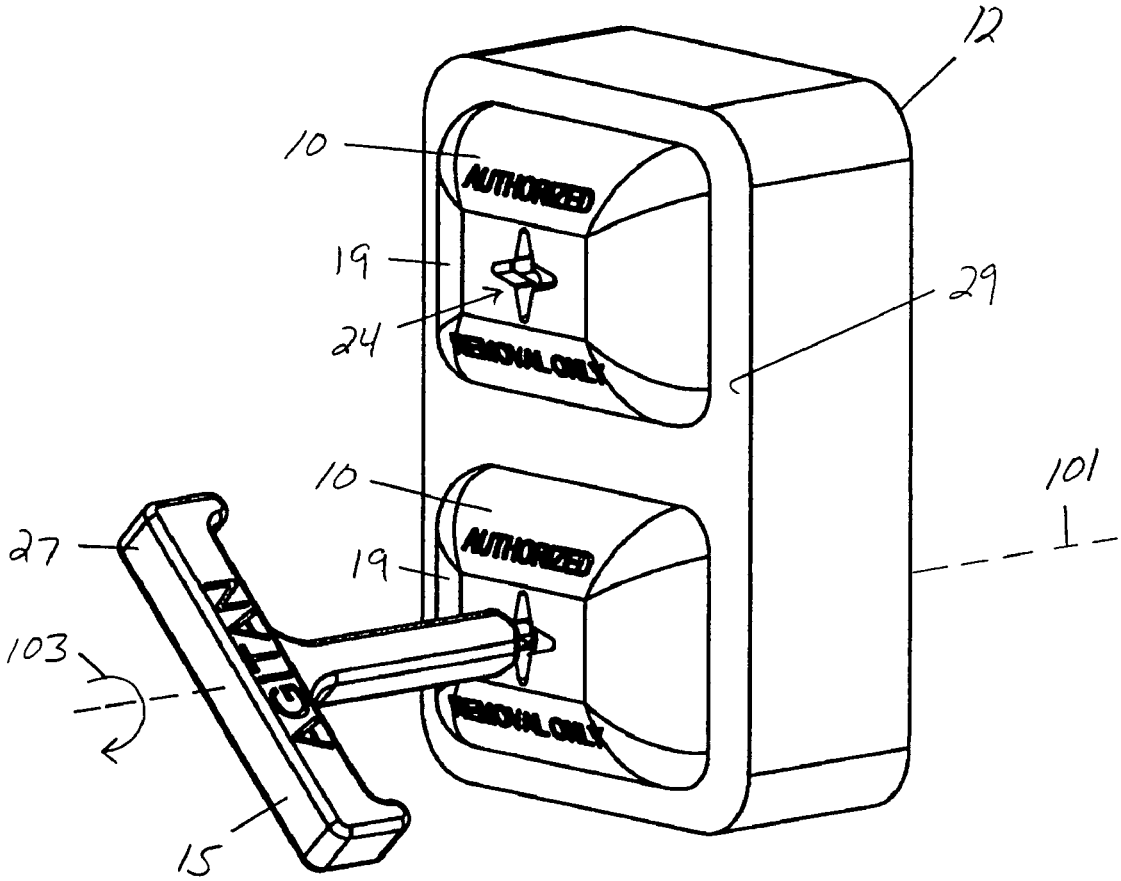
FIG. 21 is an anterior perspective depiction of the shroud removal tool otherwise shown in FIG. 20 being rotated about a tool axis of rotation.
Figure 22:
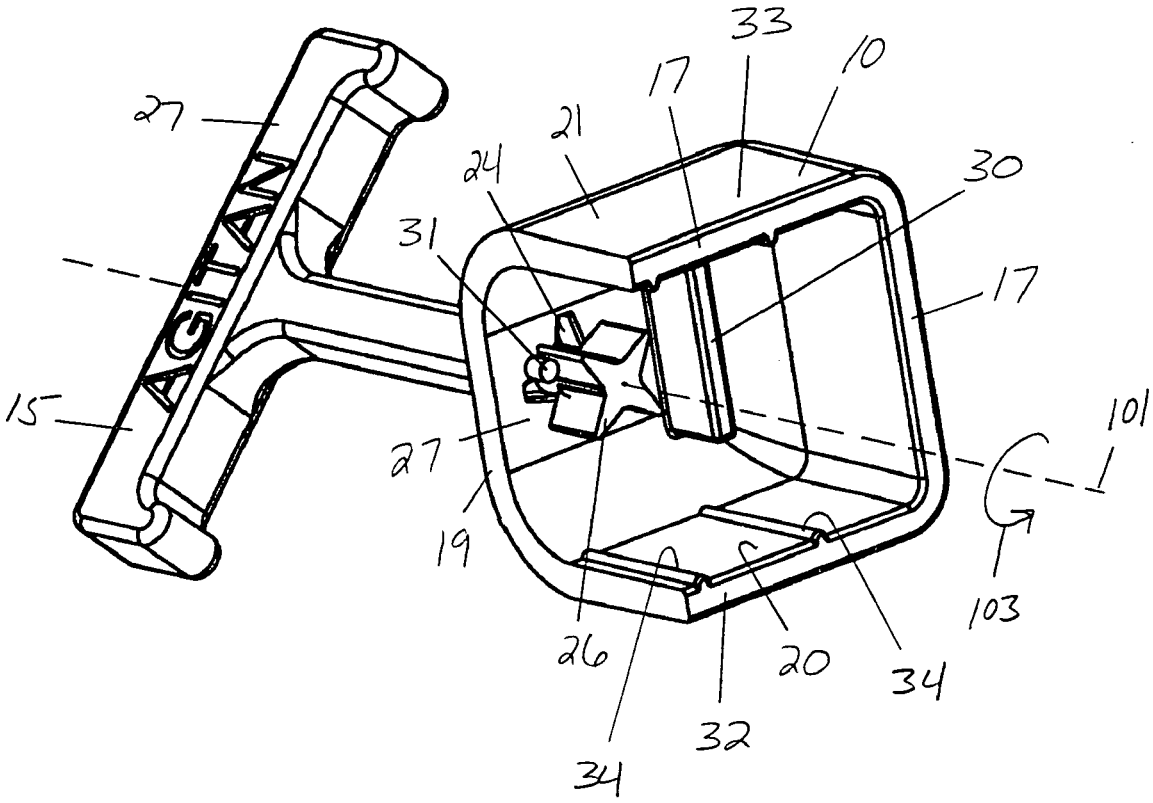
FIG. 22 is a posterior perspective depiction of the shroud removal tool otherwise shown in FIG. 21 being rotated about the tool axis of rotation with the shroud-engaging end engaging a posterior bearing surface of a fragmentary receptacle shroud.
Figure 23:
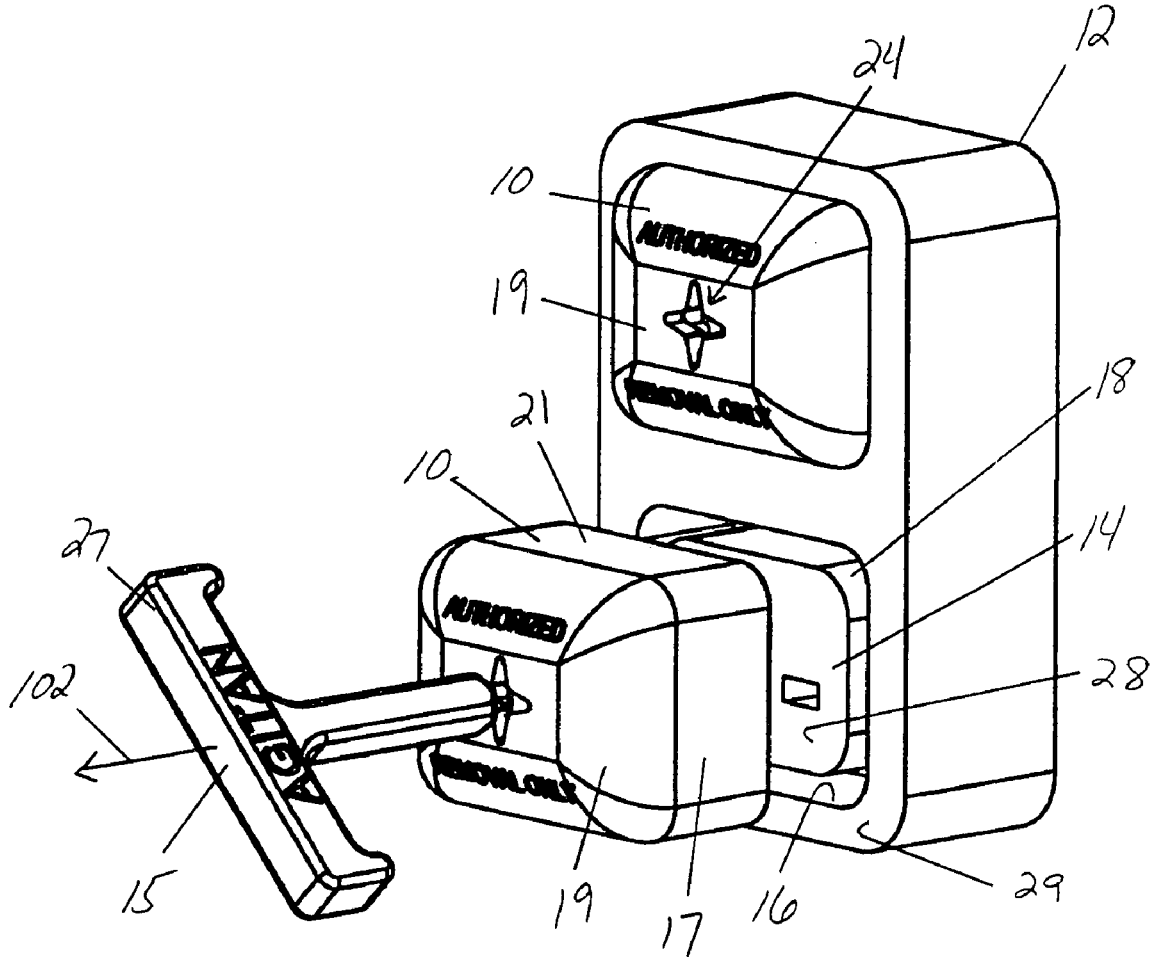
FIG. 23 is an anterior perspective depiction of the shroud removal tool otherwise shown in FIG. 21 removing the receptacle shroud from frictional engagement with the shroud-receiving channel of the lower electrical receptacle site.

Power strip-based receptacles are often targeted for power by unauthorized users and when tapped may interfere with power requirements of mainline power driven machinery, as might be defined by computer equipment. It is thus contemplated that the receptacle shroud 10 of the present invention supports an inventive receptacle shrouding system for restricting unauthorized access to computer cabinet power strip-based electrical receptacles. In this regard, it is contemplated that the receptacle shrouding system of the present invention may be said to comprise, in combination, a series of electrical receptacle sites as generally depicted in FIGS. 5 and 16; and a series of receptacle shrouds 10; and at least one shroud removal tool. The receptacle shrouds 10 may be removed from frictional engagement with the receptacle sites by way of the shroud removal tool 15 as illustrated and referenced in FIGS. 8-12, and 19-23.

The receptacle sites of the present invention are thought to essentially and preferably comprise a receptacle pedestal 14; a pedestal-bounding strip wall as at 16 in FIGS. 5, 12, 16, 23, and 24; a continuous structure-receiving channel or shroud-receiving channel 11; and a substantially planar strip surface 29 as illustrated and referenced in FIGS. 2, 5, 8-10, 12, 13, 16, 19-21, 23, and 26-29. The receptacle, being bound by the shroud-receiving channel 11, is essentially in the form of a receptacle pedestal 14, which receptacle pedestal 14 essentially comprises a pedestal wall as at 18 in FIGS. 5-7, 12, 16-18, and 23-25. It may be seen from an inspection of the noted figures that the structure-receiving channel or shroud-receiving channel 11 is essentially defined by the void extending intermediate the pedestal wall 18 and the strip wall 16. The shroud-receiving channel 11 is central to the practice of the present invention and preferably comprises a substantially uniform channel depth and a substantially uniform channel width, particularly at shroud-channel interfacing. It is contemplated that the preferred uniform channel width, per IEC standards, is on the order of 2.5 to 3.5 millimeters as at reference numeral 25 in FIG. 24.

It is contemplated that the receptacle shroud 10 of the present invention preferably comprises a channel-filling or channel-engaging wall as at 17 in FIGS. 3, 4, 6, 7, 11, 12, 14, 15, 17, 18, and 22-29; and an access-restrictive dome or domed receptacle cover 19 as illustrated and referenced in FIGS. 2-4, 8-15, 19-23, and 26-29. The channel-filling or channel-engaging wall 17 preferably comprises an inner pedestal-engaging surface 20 as referenced in FIGS. 4, 6, 7, 11, 15, 17, 18, and 24; an outer strip-engaging surface 21 as referenced in FIGS. 3, 4, 6, 7, 11, 12, 14, 15, 17, 18, and 22-25; a substantially uniform wall depth as at 22 in FIGS. 26-29; and a substantially uniform wall thickness 23 as referenced in FIGS. 4, 6, 7, 11, 15, 17, 18, 22, and 24.

Figure 24:
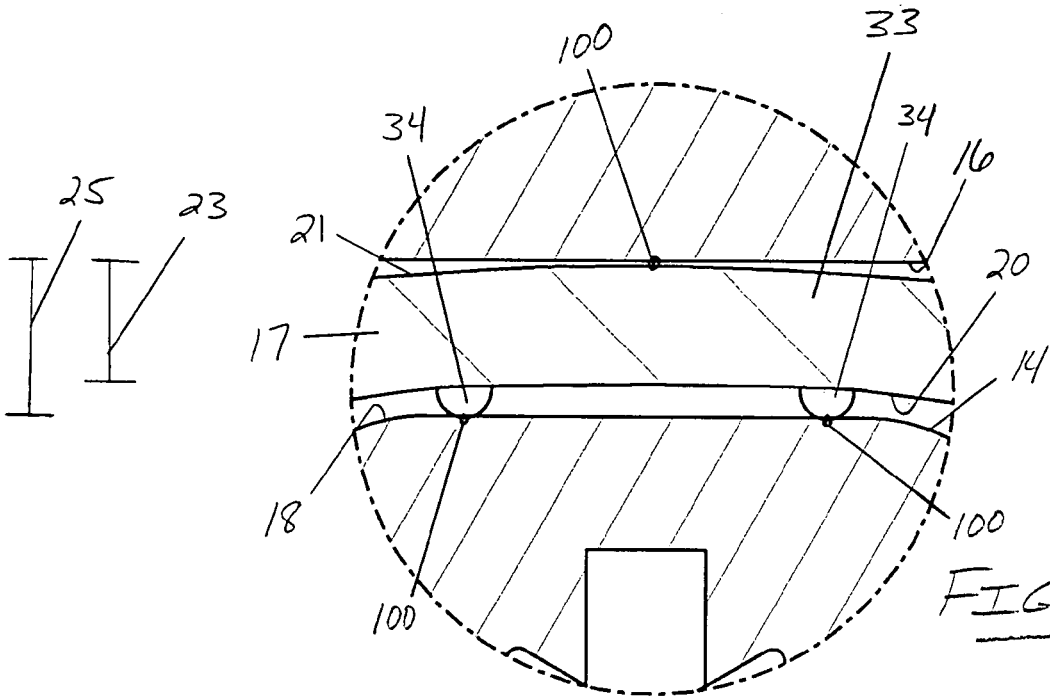
FIG. 24 is a fragmentary enlarged sectional view of shroud-channel interfacing (as sectioned from FIG. 25) showing a channel-engaging wall of a receptacle shroud sandwiched intermediate an upper pedestal-bounding wall structure of a power strip and a lower pedestal wall.
Figure 25:
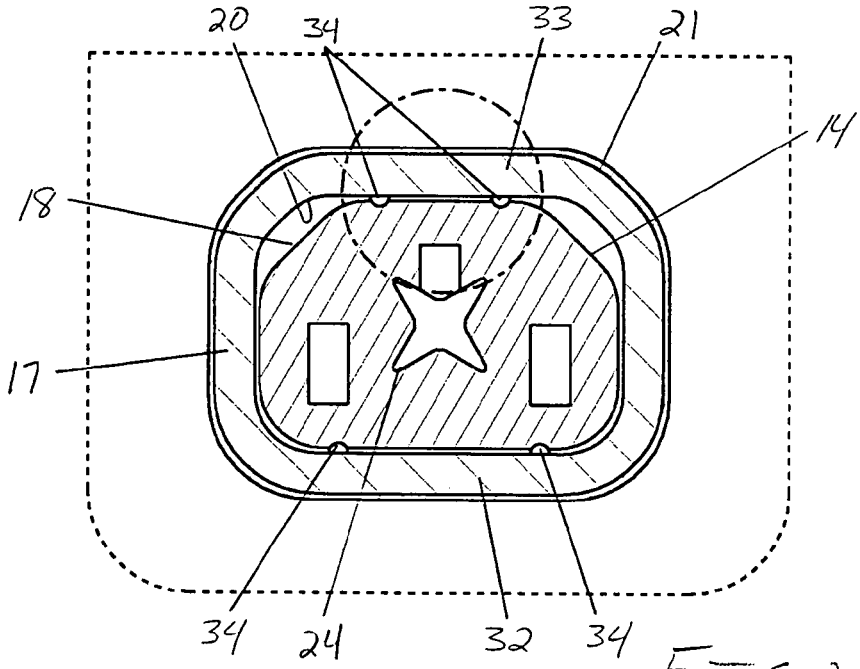
FIG. 25 is a representation of the structures set forth in FIG. 7 with the receptacle pedestal shown in solid lines and receptacle cover spacing structure removed.
Figure 26:
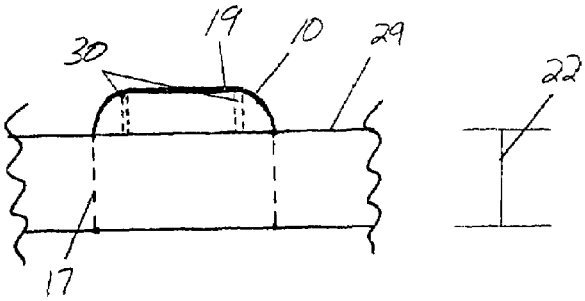
FIG. 26 is a side view depiction of the first alternative receptacle shroud frictionally received in a shroud-receiving channel of a power strip depicting a rounded access-restrictive dome of the receptacle shroud and a planar upper surface of the power strip.
Figure 27:
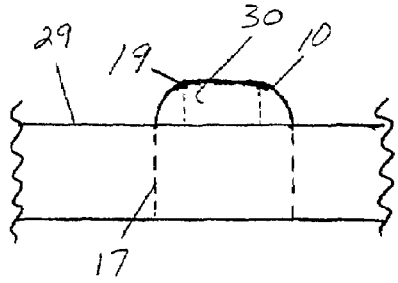
FIG. 27 is an end view depiction of the first alternative receptacle shroud frictionally received in a shroud-receiving channel of a power strip depicting a rounded access-restrictive dome of the receptacle shroud and a planar upper surface of the power strip.
Figure 28:
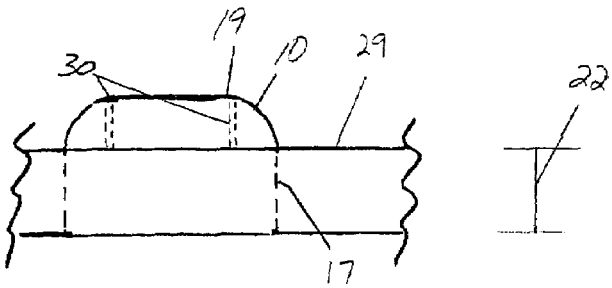
FIG. 28 is a side view depiction of the second alternative receptacle shroud frictionally received in a shroud-receiving channel of a power strip depicting a rounded access-restrictive dome of the receptacle shroud and a planar upper surface of the power strip.
Figure 29:
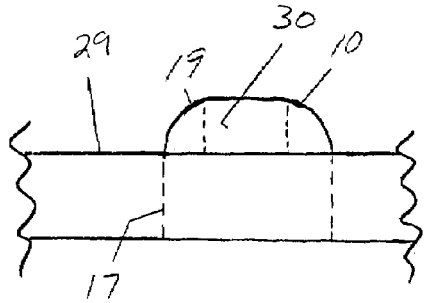
FIG. 29 is an end view depiction of the second alternative receptacle shroud frictionally received in a shroud-receiving channel of a power strip depicting a rounded access-restrictive dome of the receptacle shroud and a planar upper surface of the power strip.

From a comparative inspection of the figures depicting the shroud-receiving channel 11 versus the figures depicting the channel-engaging wall 17, is should be readily understood that the channel-engaging wall 17 is preferably dimensioned or sized and shaped for snug insertion in the shroud-receiving channel 11 and retainable by friction forces at shroud-channel interfacing, which friction forces may be envisioned as pointing into the page at points 100 in FIG. 24. It is contemplated that receptacle shroud 10 may preferably comprise or be constructed from thermoplastic polymeric material(s). Excellent results have been obtained, for example, when nylon 66 serves as the medium from which receptacle shroud 10 is constructed. Notably, nylon 66 has a relatively low coefficient of friction (on the order of 0.09) and thus the force magnitude (s) inherent at the shroud-channel interfacing are central to setting the required withdrawal forces.

It is contemplated that the receptacle pedestal 14 (and the pedestal wall 18) and the pedestal-bounding strip wall 16 are formed from substantially rigid materials relative to the preferred material construction of the receptacle shroud 10. In this regard, it is contemplated that the preferred material construction of the channel-engaging wall 17 is elastically deformable relative to the bounding materials. Nylon materials, for example, have a rather modest modulus of elasticity as compared to materials used in the construction of receptacle pedestal 14 and the pedestal-bounding strip wall 16, but a rather robust modulus of elasticity as compared to other polymeric materials. Nylon 66 is rated as having a modulus of elasticity on the order of 1-3.5 GPa. Excellent results have been obtained using nylon 66 for increasing the friction forces 100 at shroud-channel interfacing and thus for increasing the strength of the interference fit of the receptacle shroud 10.

The channel-engaging wall 17 preferably comprises a first wall portion 32 and an opposed second wall portion 33 as generally illustrated and referenced in FIGS. 4, 6, 7, 11, 15, 17, 18, 22, and 25. When in a relaxed wall state, the first and second wall portions 32 and 33 are substantially planar and parallel as generally depicted in the noted figures. When in an actuated wall state, however, (i.e. when inserted into shroud-receiving channel 11), the first and second wall portions 32 and 33 become elastically arced or rounded as generally depicted in FIG. 24. It is contemplated that the arced first and second wall portions 32 and 33 may well function to increase, enhance, or modify the friction forces 100 at shroud-channel interfacing and thus increase, enhance, or modify the strength of the interference fit.

In this last regard, it is contemplated that the receptacle shroud 10 of the present invention may further comprises certain means for governing wall deflection of the channel-engaging wall 17 so as to govern or direct the friction forces 100 at shroud-channel interfacing. In other words, the means for governing wall deflection may well operate to impart pre-specified or select radii of curvature to the arced first and second wall portions 32 and 33 when in the actuated wall state. It is contemplated that the means for governing wall deflection may be preferably defined by paired, laterally-spaced interference bumps 34 or space-paired interference bumps integrally formed at the inner pedestal-engaging surface 20 upon select wall portions (the select wall portions being selected from the group consisting of the first and second wall portions 32 and 33) as generally illustrated and referenced in FIGS. 4, 7, 11, 15, 18, 22, 24, and 25. From a general inspection of the noted figures, and from a particular inspection of FIG. 7, it may be readily understood that the interference bumps 34 function to specifically or pointedly increase the wall width at laterally spaced wall positions. The magnitude of lateral spacing intermediate paired interference bumps 34 and the difference between the channel width 25 and the wall thickness 23 together determine the arc length intermediate paired interference bumps 34. The arc length intermediate paired interference bumps 34 further determines the pre-specified or select radii of curvature for modifying or governing the friction forces at the shroud-channel interfacing. In other words, it is contemplated that the arced material portions may well operate to selectively direct the friction forces at the shroud-channel interfacing.

It may be seen from an inspection of FIGS. 2, 3, 4, 6-15, 17-24, it may be further understood that the access-restrictive dome or domed receptacle cover 19 preferably comprises a tool-receiving aperture 24. Tool-receiving aperture 24 is preferably sized and shaped or keyed to receive the shroud-engaging end 26 of the shroud removal tool 15. In the preferred embodiment, it is contemplated that the shroud removal tool 15 may preferably comprise a star-shaped shroud-engaging end 26 as generally illustrated in FIGS. 8, 11, 19, and 22. From a comparative inspection of the figures depicting the aperture 24 versus the figures depicting the shroud-engaging end 26, it may be readily understood that the transverse profile of the shroud-engaging end 26 is similarly shaped as the aperture 24, but of slightly lesser size so as to allow the shaped insertion of shroud-engaging end 26 into aperture 24.

Opposite the shroud-engaging end 26 is a handle end 27 of the shroud removal tool 15 as further depicted and referenced in FIGS. 8-12, and 19-23. The shroud-engaging end 26 is matable with, cooperable with or insertable through or into the tool-mating structure or aperture 24 and the handle end 27 enables a user to manually impart shroud removing forces (as at vector arrow 102 in FIGS. 12 and 23) to the shroud-engaging end 26. More particularly, the shroud removal tool 15 operates under rotational motion as at arrow 103 after being inserted through aperture 24. The shroud removal tool 15 may thus be said to comprise a tool axis of rotation as at 101 in FIGS. 10, 11, 21, and 22.

Certain arm or tool stop structure 31 may preferably be formed at the bearing surface 27 adjacent the aperture 24 of the access-restrictive dome 19 for preventing hyper-rotation of the tool 15 about the axis of rotation 101 and for maximizing the effectiveness of the dome-engaging arms of the shroud-engaging end 26. Exemplary arm or tool stop structure(s) 31 are illustrated and referenced in FIGS. 4, 11, 15, and 22. Being preferably symmetric or star-shaped in transverse profile, the shroud-engaging end 26 preferably comprises opposing dome-engaging arms or structure, which structure functions to impart substantially symmetric shroud-removing forces to the bearing surface 27 of the access-restrictive dome 19 as generally depicted and referenced in FIGS. 11 and 22. It is contemplated that the shroud-engaging end 26 preferably comprises symmetric load-bearing structure so as to balance removal forces and enhance removal of the receptacle shroud 10. Further, it is contemplated that the spacing intermediate the bearing surface 27 and the plug-engaging face 28 is of sufficient magnitude to accept a thickened or bulky shroud-engaging end 26. It is contemplated that a shroud-engaging end 26 having about 0.1875 inches thickness and formed from a rigid polymeric material may well operate to prevent tool failure during shroud removal.

It should be understood that the shroud-engaging end 26 is preferably keyed with or to the tool-receiving aperture 24 such that when the shroud-engaging end 26 is rotated intermediate the inner bearing surface 27 of the access-restrictive dome or receptacle cover 19 and the plug-engaging face 28 of the receptacle pedestal 14 (as referenced in FIGS. 5, 12, 16, and 23), the keyed shroud-engaging end 26 imparts shroud removing forces 102 substantially parallel to the axis of rotation 101. The shroud-engaging end 26 thus functions to transfer shroud-removing forces 102 to the receptacle shroud 10 via the inner bearing surface 27 of the preferably domed receptacle cover 19. Notably, the shroud-removing forces 102 should not exceed 50 N, but should be sufficient or operable to overcome friction forces 100 at the shroud-channel interfacing (generally depicted in FIG. 24) to remove the channel-engaging wall 17 from the structure-receiving channel 11.

As earlier stated, the receptacle pedestal 14 preferably comprises a substantially planar plug-engaging face 28 and the power or surge strip 12 preferably comprises a substantially planar strip surface 29. It is further contemplated that the plug-engaging face and the strip surface 29 are preferably coplanar. The access-restrictive dome or receptacle cover 19 is preferably positioned in spaced adjacency to the plug-engaging face 28 for operably receiving the shroud-engaging end 26 (i.e. for enabling rotation of the shroud-engaging end 26 intermediate the bearing surface 27 and the plug-engaging face). In order to insure proper spacing, it is contemplated that the receptacle shroud 10 of the present invention may further preferably comprise certain means for uniformly positioning the access-restrictive dome 19 in spaced adjacency to the plug-engaging face 28. In this regard, it is contemplated that the means for uniformly positioning the access-restrictive dome in spaced adjacency to the plug-engaging face 28 may be preferably defined by certain face-engaging stop structure 30 of substantially uniform depth as illustrated and referenced in FIGS. 4, 6, 7, 11, 15, 17, 18, 22, and 26-29. It is contemplated that the face-engaging stop structure 30 may well function to properly and uniformly position the access-restrictive dome 19 in spaced adjacency to the plug-engaging face 28.

A further structural reason for properly positioning the access-restrictive dome or receptacle cover 19 in spaced adjacency to the plug-engaging face 28 is to orient the domed surface in adjacency to the strip surface 29 as generally depicted in FIGS. 2, 8-10, 12, 13, 19-21, 23, and 26-29. It is contemplated that in the preferred embodiment, the access-restrictive dome or domed receptacle cover 19 may well function to prevent unauthorized pincer-enabled access to the receptacle pedestal 14 as, for example, by preventing pincer-enabled removal of the receptacle shroud 10 or preventing a pincer grasp or similar other tool grasp of the receptacle shroud 10. In other words, if an unauthorized user were to attempt to gain access to an otherwise shrouded electrical receptacle by removing the receptacle shroud 10 with a pincers, pliers, or similar other grasping tool, the domed receptacle cover 19 and the relatively low coefficient of friction of the material construction may well function to prevent grasping action on the receptacle shroud 10.

While the foregoing descriptions contain much specificity, this specificity should not be construed as limitations on the scope of the invention, but rather as an exemplification of the invention. For example, it is contemplated that the present invention essentially teaches a receptacle shroud 10 for use in combination with a receptacle pedestal 14, which receptacle pedestal 14 may otherwise function to receive a shrouded plug (not specifically illustrated). The receptacle shroud 10 is cooperable with the shroud-receiving channel 11 to restrict unauthorized access to the underlying receptacle pedestal 14. Notably, C13 and C19 type receptacle pedestals 14 have been illustrated as shroudable by C13 and C19 type receptacle shroud(s) 10. These, however, are exemplary and are not meant to limit the scope of the present invention. The essence of the invention inherently teaches a receptacle shroud 10 that is frictionally retainable in a pedestal-bounding channel as referenced at 11. A C15 type receptacle pedestal, for example, could very well be shrouded by the receptacle shroud as taught by the receptacle shroud 10 as specified and claimed herein.

Further, it is contemplated that the foregoing specifications teach a tool kit for selectively outfitting power strips and the like for restricting unauthorized access to a channel-bound electrical receptacle(s) located on said strips. In this regard, it is contemplated that the tool kit of the present invention may be said to essentially comprise a receptacle shroud 10 and a shroud removal tool 15. The receptacle shroud 10 essentially comprises a channel-engaging wall 17 and an access-restrictive dome 19. The channel-engaging wall 17 comprises an inner wall surface (such as surface 20), an outer wall surface (such as surface 21), and a substantially uniform wall thickness (as at 23 in FIG. 24). The access-restrictive dome 19 comprises a tool-receiving aperture 24. The channel-engaging wall 17 is sized and shaped for snug or frictional insertion in a structure-receiving channel (such as shroud-receiving channel 11). The structure-receiving channel 11 bounds a receptacle pedestal 14, and the channel-engaging wall 17 is retainable by friction forces at shroud-to-channel interfacing.

The shroud removal tool 15 comprises a shroud-engaging end 26 and a handle end 27. The shroud-engaging end 26 is cooperable with the tool-receiving aperture 24 and the handle end 27 enables a user to manually impart shroud-removing forces to the shroud-engaging end 26. The shroud-engaging end 26 transfers the shroud-removing forces to the receptacle shroud 10 and are operable to remove the channel-engaging wall 17 from frictional engagement with the structure-receiving channel 11.

It is further contemplated that the shroud removal tool 15 may well function to remove the receptacle shroud 10 from engagement with the channel 11 either by way of preferred insertion of the male shroud-engaging end 26 into the tool-receiving aperture 24, or by way of reversed sex engagement. In other words, it is contemplated that the shroud-engaging end may well comprise female structure sized and shaped to receive certain tool-mating structure otherwise formed on or cooperably associated with the access-restrictive dome 19. So long as the shroud-engaging end is matable with the access-restrictive dome 19 so as to enable the transfer of shroud-removing forces thereto, it is contemplated that the essence of the invention is practiced.

Although the invention has been described by reference to certain preferred embodiments and an inherent tool kit supported by the apparatus, it is not intended that the novel apparatus or kit be limited thereby, but that modifications thereof are intended to be included as falling within the broad scope and spirit of the foregoing disclosure and the appended drawings.

I claim:

1. A receptacle shrouding system, the receptacle shrouding system for restricting unauthorized access to an electrical receptacle, the receptacle shrouding system comprising, in combination:

an electrical receptacle site, the electrical receptacle site comprising a receptacle pedestal, a pedestal-bounding strip wall, and a shroud-receiving channel, the receptacle pedestal comprising a pedestal wall, the shroud-receiving channel extending intermediate the pedestal and strip walls;

a receptacle shroud, the receptacle shroud comprising a channel-engaging wall and an access-restrictive dome, the access-restrictive dome comprising a tool-receiving aperture, the channel-engaging wall being snugly received in the shroud-receiving channel and retained by frictional forces at shroud-channel interfacing; and a shroud removal tool, the shroud removal tool comprising a shroud-engaging end and a handle end, the shroud-engaging end being cooperable with the tool-receiving aperture, the handle end for enabling a user to impart shroud-removing forces to the shroud-engaging end, the shroud-engaging end for transferring said shroud-removing forces to the receptacle shroud, said shroud-removing forces being operable to remove the channel-engaging wall from the shroud-receiving channel.

2. The receptacle shrouding system of claim 1 wherein the electrical receptacle site comprises a substantially planar strip surface and the receptacle pedestal comprises a substantially planar plug-engaging face, the strip surface and the plug-engaging face being substantially co-planar, the access-restrictive dome being positioned in space adjacency to the plug-engaging face for operably receiving the shroud-engaging end.

3. The receptacle shrouding system of claim 2 wherein the shroad removal tool comprises and axis of rotation, the shroud-engaging end comprising symmetric dome-engaging anus, the dome engaging arms for imparting symmetiic shroud-removing forces to the access-restrictive dome, the symmetric shroud-removing forces for enhancing removal of the receptacle shroud.

4. The receptacle shrouding system of claim 3 wherein the receptacle shroud comprises arm stop structure, the arm stop structure for preventing hyper-rotation about the axis of rotation and for maximizing the effectiveness of the dome-engaging arms.

5. The receptacle shrouding system of claim 2 wherein the receptacle shroud comprises face-engaging stop structure, the face-engaging stop structure for uniformly positioning the access-restrictive dome in spaced adjacency to the plug-engaging face.

6. The receptacle shrouding system of claim 2 where the access-restrictive dome comprises a rounded dome surface at the strip surface, the rounded dome surface for preventing unauthorized pincer-enable access to the receptacle pedestal.

7. The receptacle shrouding system of claim 1 where the receptacle pedestal and the pedestal-bounding strip wall comprise substantially rigid materials and the channel-engaging wall comprises elastically deformable material, the elastically deformable material for increasing the friction forces at shroud-channel interfacing.

8. The receptacle shrouding system of claim 7 wherein the channel-engaging wall comprises a first wall portion and a second wall portion, the first and second wall portions being opposed to one another, the first and second wall portions being substantially parallel when in a relaxed wall state and arced when in an actuated wall state, the arced first and second wall portions for incrcasing the frictional forces at shroud-channel interfacing.

9. The receptacle shrouding system of claim 8 wherein the receptacle shroud comprises means for governing wall deflection, said means operating to impart select radii of curvature to the arced first and second wall portions.

10. The receptacle shrouding system of claim 9 wherein the means for governing wall deflection are defined by paired, laterally-spaced interference bumps integrally formed upon select wall portions, the interference bumps specifically increasing the wall width at laterally spaced wall positions, the lateral spacing intermediate paired interference bumps for determining the arc length intermediate paired interference bumps, the arc length intermediate paired interference bumps for determining the select radii of curvature.

11. A tool kit for restricting unauthorized access to a channel-bound electrical receptacle, the tool kit comprising:

a receptacle shroud, the receptacle shroud comprising a channel-engaging wall and a receptacle cover, the receptacle cover comprising tool-mating structure, the channel-engaging wall being sized and shaped for snug insertion in a pedestal-bounding, structure-receiving channel, the channel-engaging wall being retainable by friction forces at shroud-channel interfacing; and a shroud removal tool, the shroud removal tool comprising a shroud-engaging end and a handle end, the shroud-engaging end being cooperable with the tool-mating structure, the handle end for enabling a user to impart shroud-removing forces to the shroud-engaging end, the shroud-engaging end for transferring said shroud-removing forces to the receptacle shroud, said shroud-removing forces being operable to remove the channel-engaging wall from the structure-receiving channel.

12. The tool kit of claim 11 wherein the receptacle cover is positionable in spaced adjacency to an electrical receptacle, the positionable receptacle cover for enabling rotation of the shroud-engaging end.

13. The tool kit of claim 11 wherein the receptacle shroud comprises means for uniformly positioning the receptacle cover in spaced adjacency to an electrical receptacle.

14. The tool kit of claim 11 wherein the receptacle cover comprises a rounded dome surface, the rounded dome surface for preventing pincer-enabled removal of the receptacle shroud.

15. The tool kit of claim 11 wherein the channel-engaging wall comprises elastically deformable material, the elastically deformable material for increasing the friction forces at shroud-channel interfacing.

16. The tool kit of claim 15 wherein the channel-engaging wall comprises select wall portions, the select wall portions being substantially planar when in a relaxed wall state and arced when in an actuated wall state, the arced wall portions for enhancing the friction forces at shroud-channel interfacing.

17. The tool kit of claim 16 wherein the receptacle shroud comprises means for governing wall deflection, said means operating to selectively impart radii of curvature to the arced wall portions.

18. The tool kit shrouding system of claim 17 wherein the means for governing wall deflection are defined by paired, laterally-spaced interference bumps formed upon select wall portions of the channel-filling wall, the interference bumps pointedly increasing the wall width at laterally spaced wail positions, the lateral spacing intermediate paired interference bumps, the arc length intermediate paired interference bumps for selectively imparting the radii of curvature.

19. A combination tool-shroud assembly, the tool-shroud assembly for restricting unauthorized access to a channel-bound receptacle, the tool-shroud assembly comprising, in combination:

a receptacle shroud and a shroud removal tool, the receptacle shroud comprising a channel-engaging wall and a receptacle cover, the receptacle cover comprising tool-mating structure, the channel-engaging wall being sized and shaped for snug insertion in a receptacle channel, the receptacle channel bounding a receptacle, the channel-engaging wall being retainable by friction forces at shroud-channel interfacing, the shroud removal tool comprising a shroud-engaging end cooperable with the tool-mating structure, the shroud-engaging end for transferring shroud-removing forces to the receptac1e shroud via the tool-mating structure. said shroud-removing forces being operable to remove the channel-engaging wall from the receptacle channel.

20. The shroud assembly of claim 19 wherein the receptacle cover comprises a domed surface, the domed surface for preventing pincer grasp of the receptacle shroud.

21. The shroud assembly of claim 19 wherein the channel-engaging wall comprises elastically deformable material, the elastically deformable material for increasing the friction forces at shroud-channel interfacing.

22. The shroud assembly of claim 21 wherein the elastically deformable material is substantially planar when in a relaxed material state and arced when in an actuated material state, the arced material portions for selectively enhancing the friction forces at shroud-channel interfacing.

23. The shroud assembly of claim 22 comprising means for governing-wall deflection, said means for selectively imparting radii of curvature to the arced material portions.

24. The shroud assembly of claim 23 wherein the means for governing wall deflection are defined by spaced-paired interference bumps formed upon select wall portions of the channel-engaging wall, the space-paired interference bumps pointedly increasing the wall width at select wall positions, the spacing intennediate space-paired interference bumps for detennining the arc length intermediate space-paired interference bumps, the arc length intermediate space-paired interference bumps for selectively imparting the radii of curvature.

* * * * *